US009922660B2

(12) United States Patent
Yamamoto et al.

(10) Patent No.: US 9,922,660 B2
(45) Date of Patent: Mar. 20, 2018

(54) DEVICE FOR EXPANDING FREQUENCY BAND OF INPUT SIGNAL VIA UP-SAMPLING

(71) Applicant: SONY CORPORATION, Tokyo (JP)

(72) Inventors: Yuki Yamamoto, Tokyo (JP); Toru Chinen, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/034,947

(22) PCT Filed: Nov. 17, 2014

(86) PCT No.: PCT/JP2014/080322

§ 371 (c)(1),
(2) Date: May 6, 2016

(87) PCT Pub. No.: WO2015/079946

PCT Pub. Date: Jun. 4, 2015

(65) Prior Publication Data

US 2016/0284361 A1 Sep. 29, 2016

(30) Foreign Application Priority Data

Nov. 29, 2013 (JP) ..... 2013-247092

(51) Int. Cl.
*G10L 19/00* (2013.01)
*G10L 19/24* (2013.01)
(Continued)

(52) U.S. Cl.
CPC ..... *G10L 19/24* (2013.01); *G10L 19/0204* (2013.01); *G10L 19/26* (2013.01); *G10L 21/038* (2013.01); *G10L 25/18* (2013.01)

(58) Field of Classification Search
None
See application file for complete search history.

(56) References Cited

U.S. PATENT DOCUMENTS 7,205,910 B2 * 4/2007 Honma ..... G10L 21/038 341/50
7,228,271 B2 * 6/2007 Tokuda ..... H04M 1/60 381/104

(Continued)

FOREIGN PATENT DOCUMENTS

JP 2002-073096 A 3/2002
JP 2003-108197 A 4/2003

(Continued)

*Primary Examiner* — Satwant Singh
(74) *Attorney, Agent, or Firm* — Chip Law Group

(57) ABSTRACT

The present technology relates to a device, a method, and a program for expanding a frequency band, which are capable of obtaining high-quality sound with a small processing amount. A low band extraction band-pass filter processing unit passes a predetermined band of a low band of an input signal and generates a low band sub band signal. A band-pass filter calculation circuit calculates band-pass filter coefficients of band-pass filters having sub bands of high bands as a pass band based on an estimate value of high band sub band power, and an addition unit obtains one filter coefficient by adding the band-pass filter coefficients. A polyphase configuration level adjustment filter performs up-sampling and level adjustment by performing filtering on a flattened signal obtained from a low band sub band signal using the filter coefficient obtained by the addition unit, and generates a high band signal. An addition unit obtains an output signal by adding the high band signal to the low band signal. The present technology can be applied to a frequency band expanding device.

11 Claims, 13 Drawing Sheets

(51) Int. Cl.

| | |
|---|---|
| ***G10L 25/18*** | (2013.01) |
| ***G10L 21/038*** | (2013.01) |
| ***G10L 19/02*** | (2013.01) |
| ***G10L 19/26*** | (2013.01) |

(56) References Cited

U.S. PATENT DOCUMENTS

| | | | | |
|---|---|---|---|---|
| 8,239,191 | B2 * | 8/2012 | Ehara | G10L 19/265<br>704/200.1 |
| 8,554,548 | B2 * | 10/2013 | Ehara | G10L 19/26<br>375/240 |
| 8,666,733 | B2 * | 3/2014 | Toraichi | G10L 19/0208<br>704/201 |
| 9,361,894 | B2 * | 6/2016 | You | G10L 19/008 |
| 2006/0031075 | A1 * | 2/2006 | Oh | G10L 21/038<br>704/500 |
| 2008/0152152 | A1 * | 6/2008 | Kimura | H04S 7/30<br>381/17 |
| 2015/0235653 | A1 * | 8/2015 | Liu | G10L 21/0388<br>704/500 |

FOREIGN PATENT DOCUMENTS

| | | | |
|---|---|---|---|
| JP | 2013-528836 | A | 7/2013 |
| WO | 2011/043227 | A | 4/2011 |

* cited by examiner

DEVICE FOR EXPANDING FREQUENCY BAND OF INPUT SIGNAL VIA UP-SAMPLING

CROSS REFERENCE TO RELATED APPLICATIONS

This application is a U.S. National Phase of International Patent Application No. PCT/JP2014/080322 filed on Nov. 17, 2014, which claims priority benefit of Japanese Patent Application No. JP 2013-247092 filed in the Japan Patent Office on Nov. 29, 2013. Each of the above-referenced applications is hereby incorporated herein by reference in its entirety.

TECHNICAL FIELD

The present technology relates to a device, a method, and a program for expanding a frequency band, and more particularly, a device, a method, and a program for expanding a frequency band, which are capable of obtaining high-quality sound with a small processing amount.

BACKGROUND ART

For example, music distribution services for distributing music via the Internet are known. In such a music distribution service, encoded data obtained by encoding an audio signal of music or the like is distributed, and a technique of removing a high band component of the audio signal and encoding only a remaining low band component is used to compress a data amount of the encoded data.

However, when the audio signal encoded by this technique is decoded and reproduced, since the high band component included in an original signal has been lost, a sense of realism of the original sound is lost, and deterioration in audio quality in which sound is indistinct is likely to occur.

In this regard, a band expansion technique of generating a signal of a wide frequency band by generating a high band component from a signal of a low band component and adding the obtained high band component to the signal of the low band component was proposed (for example, see Patent Literature 1).

CITATION LIST

Patent Literature

Patent Literature 1: WO 2011/043227

SUMMARY OF INVENTION

Technical Problem

In recent years, for example, there is a demand for a technique of converting sound of a standard resolution that is sound of a standard sampling frequency such as 48 kHz into sound of a high resolution that is sound of a high sampling frequency.

However, when up-sampling is performed on the audio signal through a combination of the band expansion technique and the up-sampling, and then the frequency band is expanded, although high-quality sound can be obtained, the amount of processing that is performed is also correspondingly increased.

The present technology was made in light of the foregoing, and enables high-quality sound to be obtained with a small processing amount.

Solution to Problem

According to an aspect of the present disclosure, a frequency band expanding device includes: a low band extraction band-pass filter processing unit configured to pass a predetermined band of a low band side of an input signal and extract a low band sub band signal; a filter coefficient calculation unit configured to calculate a filter coefficient of a poly-phase configuration filter based on the low band sub band signal or the input signal; a level adjustment filter processing unit configured to perform up-sampling and level adjustment of the low band sub band signal by filtering the low band sub band signal through the poly-phase configuration filter of the filter coefficient and generate a high band signal; a low pass filter processing unit configured to extract a low band signal from the input signal through filtering on the input signal; and a signal addition unit configured to add the low band signal to the high band signal and generate an output signal.

The frequency band expanding device may include: a flattening unit configured to flatten the low band sub band signal in a manner that levels of the low band sub band signals of a plurality of different bands are substantially constant and generate a flattened signal; and a down-sampling unit configured to perform down-sampling on the flattened signal. The level adjustment filter processing unit may perform filtering on the flattened signal down-sampled by the down-sampling unit using the poly-phase configuration filter, and generate the high band signal.

The flattening unit may perform the flattening in a manner that levels of the low band sub band signals of a plurality of bands are substantially the same as a level of the low band sub band signal of a band at a highest band side.

The filter coefficient calculation unit may calculate band-pass filter coefficients of band-pass filters that passes a plurality of bands of a high band. The frequency band expanding device may further include a coefficient addition unit configured to obtain one filter coefficient by adding the band-pass filter coefficients calculated for the plurality of bands of the high band.

The frequency band expanding device may further include: an estimating unit configured to calculate estimate values of levels of signals of the bands for the plurality of bands of the high band based on the low band sub band signals of the plurality of different bands. The filter coefficient calculation unit may calculate the band-pass filter coefficients based on the estimate values of the bands for the plurality of bands of the high band.

The frequency band expanding device may further include: a noise generating unit configured to generate a high band noise signal. The signal addition unit may add the low band signal, the high band signal, and the high band noise signal and generate the output signal.

The frequency band expanding device may further include: a noise level adjustment filter processing unit configured to perform up-sampling and level adjustment on the high band noise signal by performing filtering on the high band noise signal through a poly-phase configuration filter for noise.

The frequency band expanding device may further include: a noise filter coefficient calculation unit configured to calculate a filter coefficient of the poly-phase configuration filter for the noise based on the low band sub band signal or the input signal.

The low pass filter processing unit may perform up-sampling of the input signal and extraction of a low band component by performing filtering on the input signal through a poly-phase configuration filter for a low band, and generate the low band signal.

According to an aspect of the present disclosure, a frequency band expansion method or a program includes steps of: passing a predetermined band of a low band side of an input signal and extracting a low band sub band signal; calculating a filter coefficient of a poly-phase configuration filter based on the low band sub band signal or the input signal; performing up-sampling and level adjustment of the low band sub band signal by filtering the low band sub band signal through the poly-phase configuration filter of the filter coefficient and generating a high band signal; extracting a low band signal from the input signal through filtering on the input signal; and adding the low band signal to the high band signal and generating an output signal.

According to an aspect of the present technology, a predetermined band of a low band side of an input signal is passed and thereby a low band sub band signal is extracted; a filter coefficient of a poly-phase configuration filter is calculated based on the low band sub band signal or the input signal; up-sampling and level adjustment of the low band sub band signal are performed by filtering the low band sub band signal through the poly-phase configuration filter of the filter coefficient and a high band signal is generated; a low band signal is extracted from the input signal through filtering on the input signal; and the low band signal is added to the high band signal and an output signal is generated.

Advantageous Effects of Invention

According to one aspect of the present technology, it is possible to obtain high-quality sound with a small processing amount.

The effect described herein is not necessarily limited, and any effects described in the present disclosure may be included.

DESCRIPTION OF EMBODIMENTS

Hereinafter, embodiments to which the present technology is applied will be described with reference to the appended drawings.

First Embodiment

Frequency Band Expansion and Up-Sampling

First, an overview of the present technology will be described.

The present technology has the following features in particular.

(Feature 1)

Band expansion of an up-sampled signal is performed such that up-sampling and a band expansion technique are performed in series twice or more. As a result, high-quality sound is obtained.

(Feature 2)

A technique of generating a high band signal is implemented by a method using frequency aliasing rather than amplitude modulation, and thus an output signal is generated with a small processing amount.

(Feature 3)

Noise according to an estimate value of power of a high band is added to a high band signal. As a result, more natural sound can be obtained.

Hereinafter, the present technology will be described.

Figure 1:
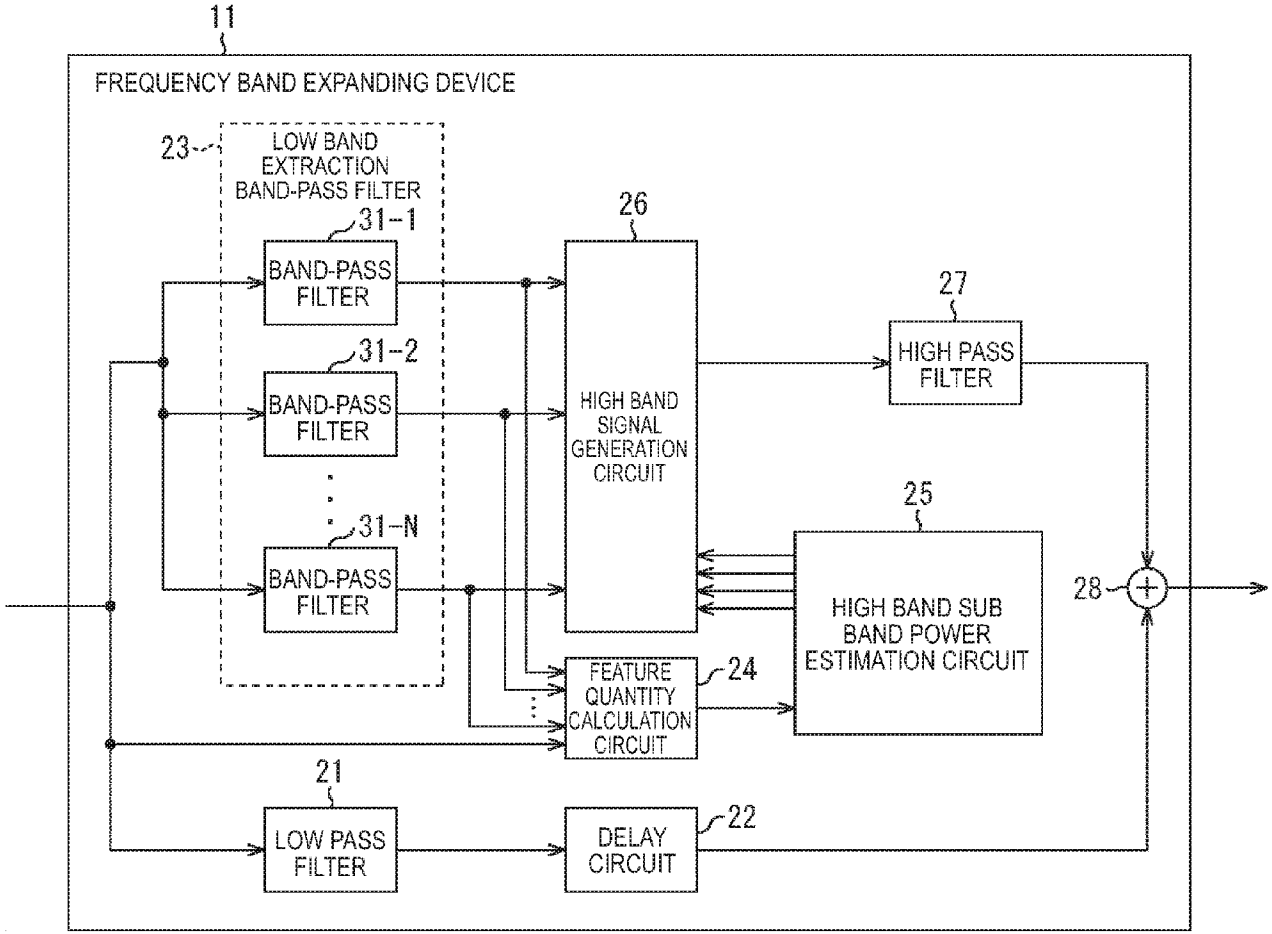
FIG. 1 is a diagram illustrating a configuration of a frequency band expanding device.

FIG. 1 is a diagram illustrating an exemplary configuration of a frequency band expanding device that expands a frequency band of an input signal that is an audio signal of a processing target.

A frequency band expanding device 11 illustrated in FIG. 1 receives a signal component of a low band as an input signal, performs a frequency band expansion process on the input signal, and outputs an output signal obtained as a result as a band-expanded audio signal. For example, the input signal is an audio signal in which the high band component has been removed from the original signal, and only the low band component remains.

Hereinafter, an end of a side having the lowest frequency in a frequency component that is generated by the frequency band expansion process is assumed to an expansion start band, a band that is higher in a frequency than the expansion start band is referred to as a "high band," and a band that is lower in a frequency than the expansion start band is referred to as a "low band."

When each of the low band and the high band is divided into a plurality of bands, one divided band is also referred to as a "sub band," and a signal of a sub band is also referred to as a "sub band signal." In the following, particularly, the sub band signal of the sub band of the low band is also referred to as a "low band sub band signal," and the sub band signal of the sub band of the high band is also referred to as a "high band sub band signal."

The frequency band expanding device 11 includes a low pass filter 21, a delay circuit 22, a low band extraction band-pass filter 23, a feature quantity calculation circuit 24, a high band sub band power estimation circuit 25, a high band signal generation circuit 26, a high pass filter 27, and an addition unit 28.

The low pass filter 21 performs filtering on the input signal using a predetermined cutoff frequency, and supplies a low band signal obtained as a result serving as the signal component of the low band to the delay circuit 22.

The delay circuit 22 delays the low band signal by a predetermined delay time for synchronization when the low band signal supplied from the low pass filter 21 is added to a high band signal which will be described later, and supplies the delayed low band signal to the addition unit 28.

The low band extraction band-pass filter 23 is configured with band-pass filters 31-1 to 31-N having different pass bands.

The band-pass filter 31-*i* (here, 1 passes a signal of a predetermined pass band, that is, a sub band at the low band side in the input signal, and supplies the signal of the predetermined band obtained as a result to the feature quantity calculation circuit 24 and the high band signal generation circuit 26 as the low band sub band signal. Thus, sub band signals of N sub bands included in the low band can be obtained through the low band extraction band-pass filter 23.

Hereinafter, when it is unnecessary to particularly distinguish the band-pass filters 31-1 to 31-N from one another, they are also referred to simply as a "band-pass filter 31."

The feature quantity calculation circuit 24 calculates one or more feature quantities using at least either of a plurality of low band sub band signals supplied from the low band extraction band-pass filter 23 and the input signal, and supplies the calculated feature quantity to the high band sub band power estimation circuit 25. Here, the feature quantity is information indicating a feature of the input signal as a signal.

The high band sub band power estimation circuit 25 calculates an estimate value of high band sub band power serving as power (level) of the high band sub band signal based on the feature quantity supplied from the feature quantity calculation circuit 24 for each of the sub bands of the high band, and supplies the calculated estimate value to the high band signal generation circuit 26.

The high band signal generation circuit 26 generates a high band signal serving as the signal component of the high band based on a plurality of low band sub band signals supplied from the low band extraction band-pass filter 23 and a plurality of estimate values of the high band sub band power supplied from the high band sub band power estimation circuit 25, and supplies the high band signal to the high pass filter 27.

The high pass filter 27 performs filtering on the high band signal supplied from the high band signal generation circuit 26 using the cutoff frequency corresponding to the cutoff frequency of the low pass filter 21, and supplies the filtered high band signal to the addition unit 28.

The addition unit 28 adds the low band signal supplied from the delay circuit 22 to the high band signal supplied from the high pass filter 27, and outputs a resulting signal as an output signal.

As described above, according to the frequency band expanding device 11, the input signal can be converted into the output signal having the wide frequency band component.

However, in the frequency band expanding device 11, the sampling frequency of the input signal is the same as the sampling frequency of the output signal, and, for example, it is hard to convert the input signal of the standard resolution in which the sampling frequency is 48 kHz or lower into the output signal of the high resolution in which the sampling frequency is higher than 48 kHz.

Figure 2:
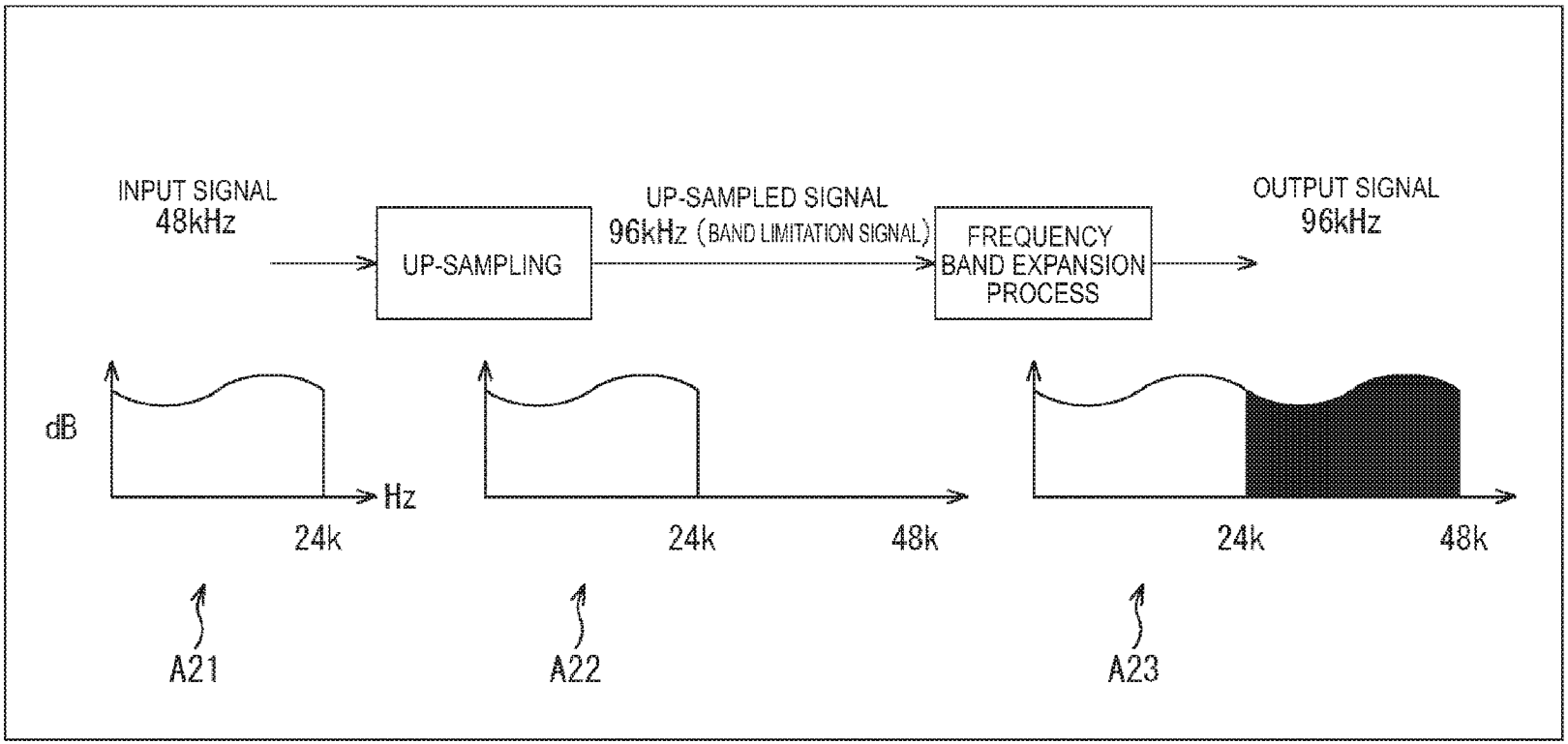
FIG. 2 is a diagram for describing up-sampling of an input signal.

In this regard, for example, by inputting the input signal to the frequency band expanding device 11 after performing up-sampling to a desired output sampling frequency as illustrated in FIG. 2, the band expansion from the input signal of the standard resolution to the output signal of the high resolution can be performed. In FIG. 2, a vertical axis and a horizontal axis indicate power (level) and a frequency of signals.

In this example, the sampling frequency of the input signal is 48 kHz. In other words, a frequency component of up to 24 kHz serving as a Nyquist frequency is included in the input signal as indicated by an arrow A21.

When the input signal undergoes up-sampling, an up-sampled signal indicated by an arrow A22 is obtained. The up-sampled signal is a signal in which the sampling frequency is 96 kHz, and substantially includes the frequency component of the input signal of up to 24 kHz, and the frequency component of 24 kHz or more is a noise component.

Further, when the up-sampled signal is input to the frequency band expanding device 11, and the frequency band expansion process is performed on the up-sampled signal, an output signal in which the frequency component of substantially up to 48 kHz is included as indicated by an arrow A23, and the sampling frequency is 96 kHz is obtained.

Here, in the frequency band expanding device 11, the cutoff frequency of the low pass filter 21 and the high pass filter 27 and an upper limit frequency and a lower limit frequency of each of the pass bands or the sub bands of the high band of the band-pass filter 31 change according to a magnification obtained by dividing the output sampling frequency by the input sampling frequency. For example, in the example of FIG. 2, since the output sampling frequency is 96 kHz, and the input sampling frequency is 48 kHz, the upper limit frequency and the lower limit frequency are doubled (=96/48).

Figure 3:
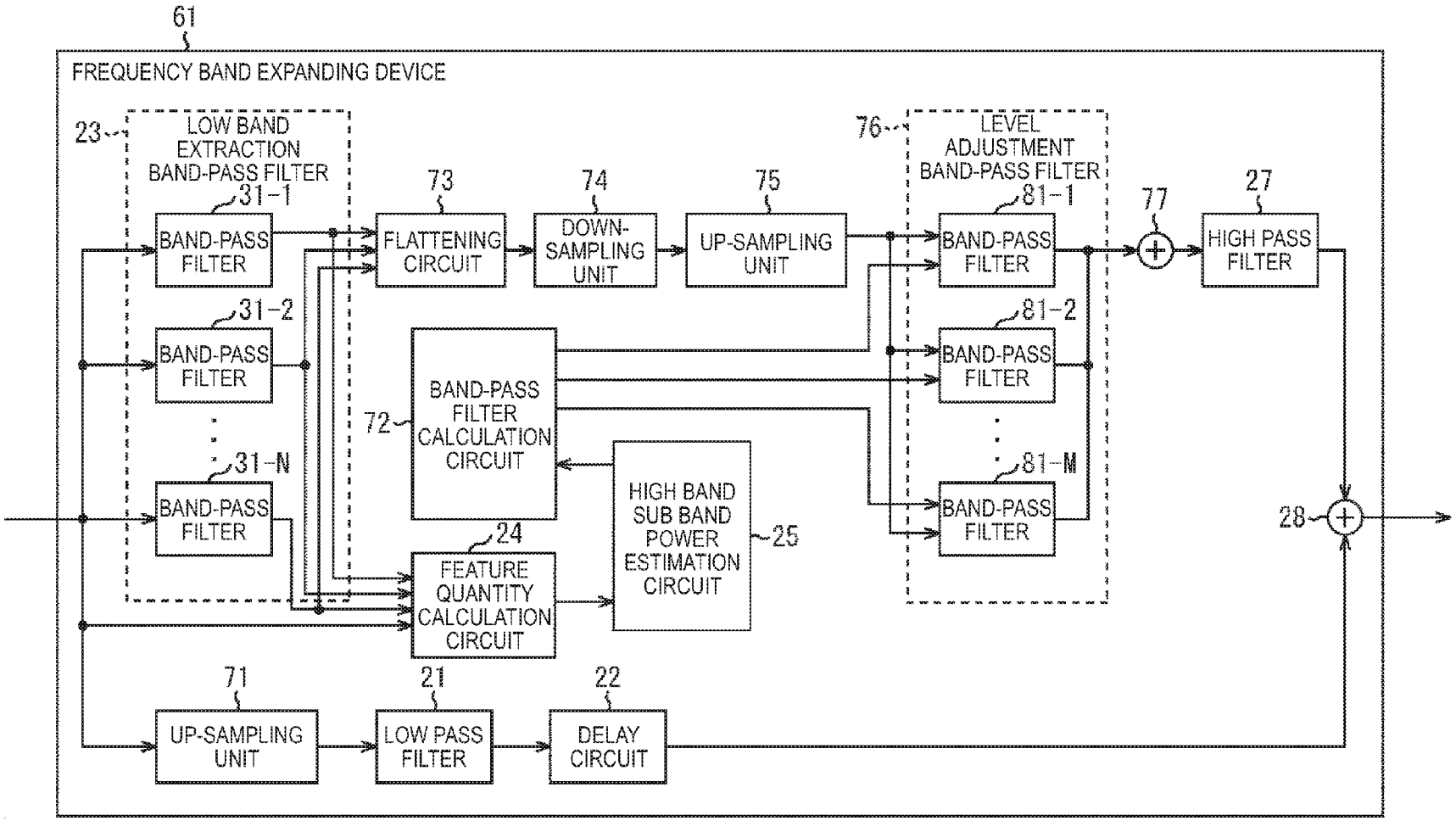
FIG. 3 is a diagram illustrating a configuration of a frequency band expanding device.

Meanwhile, when the frequency band expanding device employs, for example, the configuration illustrated in FIG. 3, the up-sampling and the frequency band expansion process of the input signal can be performed through a single device.

In FIG. 3, portions corresponding to those in FIG. 1 are denoted by the same reference numerals, and a description thereof is appropriately omitted. An example in which the up-sampling is performed on the input signal in which the sampling frequency is 48 kHz using quadruple 192 kHz, and the frequency band expansion process is performed using 24 kHz as the expansion start band will be described.

A frequency band expanding device 61 illustrated in FIG. 3 includes an up-sampling unit 71, a low pass filter 21, a delay circuit 22, a low band extraction band-pass filter 23, a feature quantity calculation circuit 24, a high band sub band power estimation circuit 25, a band-pass filter calculation circuit 72, a flattening circuit 73, a down-sampling unit 74, an up-sampling unit 75, a level adjustment band-pass filter 76, an addition unit 77, a high pass filter 27, and an addition unit 28.

The configuration of the frequency band expanding device 61 differs from that of the frequency band expanding device 11 in that the high band signal generation circuit 26 is not arranged, and the up-sampling unit 71 and the band-pass filter calculation circuit 72 to the addition unit 77 are newly arranged.

The level adjustment band-pass filter 76 includes band-pass filters 81-1 to 81-M. Hereinafter, when it is unnecessary to particularly distinguish the band-pass filters 81-1 to 81-M from one another, they are also referred to simply as a "band-pass filter 81."

Next, the respective units of the frequency band expanding device 61 will appropriately be described.

(Up-Sampling Unit and Low Pass Filter)

First, the up-sampling unit 71 inserts three zeros between the samples of the data series of the input signal, generates a signal having a sampling frequency that is four times that of the input signal, and supplies the generated signal to the low pass filter 21.

Here, since the sampling frequency of the input signal is 48 kHz, a signal having a sampling frequency of 192 kHz is generated by the up-sampling of the input signal by the up-sampling unit 71.

The low pass filter 21 performs filtering on the signal supplied from the up-sampling unit 71 using 24 kHz serving as the Nyquist frequency of the input signal as the cutoff frequency, and supplies a signal obtained as a result to the delay circuit 22.

Figure 4:
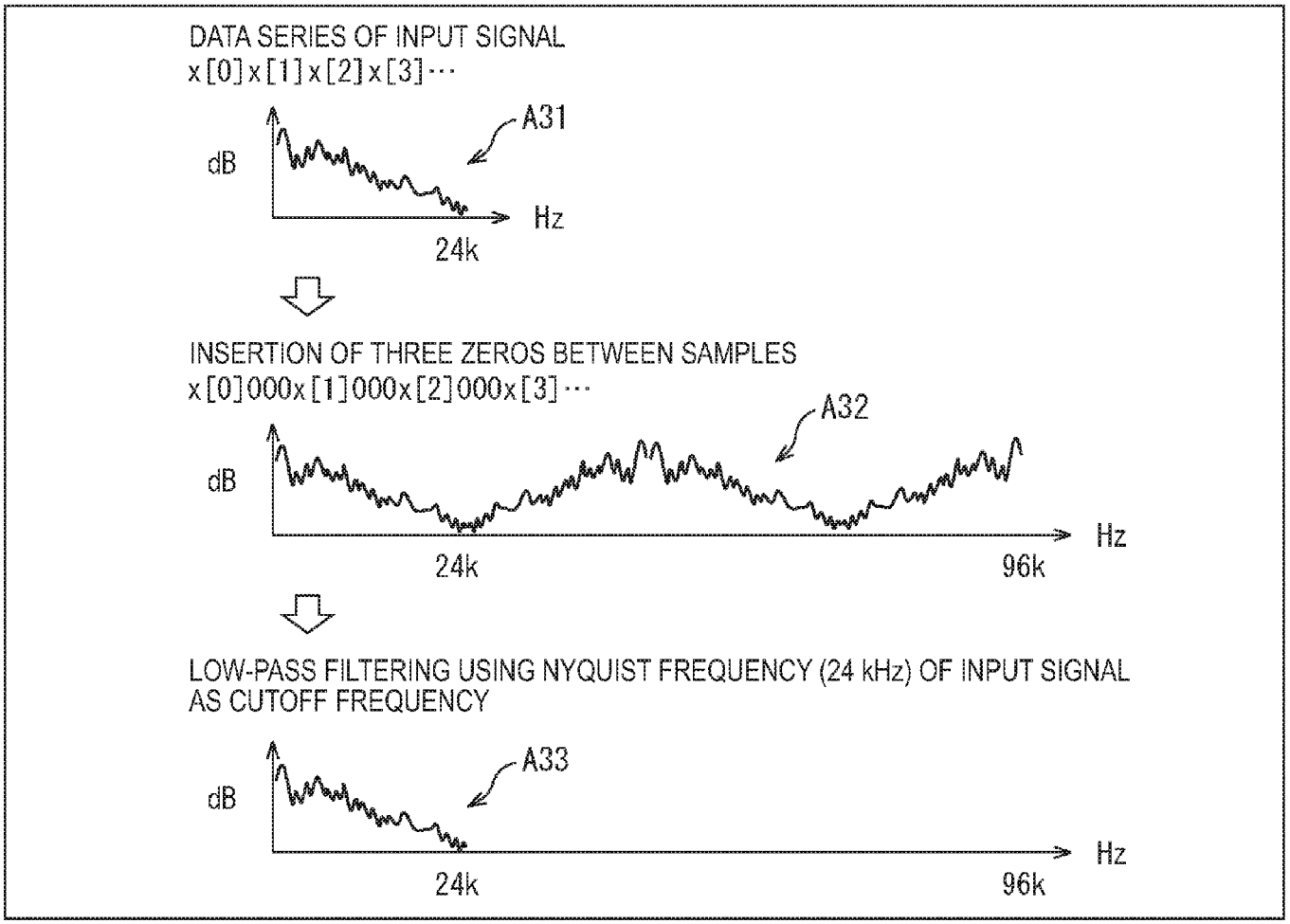
FIG. 4 is a diagram for describing generation of a low band signal.

Through the above process, for example, the signal illustrated in FIG. 4 is obtained. In FIG. 4, a vertical axis and a horizontal axis indicate power and a frequency of a signal.

For example, an input signal indicated by an arrow A31 is assumed to be supplied to the up-sampling unit 71. The input signal includes the frequency component of up to 24 kHz serving as the Nyquist frequency.

Here, when a data series of the input signal, that is, a series of sample values of samples, is assumed to be x[0], x[1], x[2], x[3], . . . , the up-sampling unit 71 inserts 3 samples in which a sample value is 0 between every two samples. As a result, the data series of the up-sampled input signal is x[0], 0, 0, 0, x[1], 0, 0, 0, x[2], 0, 0, 0, x[3], 0, 0, 0, . . . .

When the up-sampling is performed as described above, a signal indicated by an arrow A32 is obtained. A waveform of the signal becomes a waveform obtained by mirroring, that is, frequency-aliasing a waveform of the input signal indicated by the arrow A31.

In other words, a waveform of 24 kHz to 48 kHz is a waveform of a shape obtained by replicating the waveform of up to 24 kHz at 24 kHz, and a waveform of 48 kHz to 96 kHz is a waveform of a shape obtained by replicating the waveform of up to 48 kHz at 48 kHz.

When the up-sampling is performed on the input signal as described above, a signal including a frequency component of substantially up to 96 kHz is obtained, but a component of a frequency of 24 kHz or more is an extra component that is not included in an original signal.

In this regard, the low pass filter 21 performs filtering on the up-sampled input signal through the low pass filter using 24 kHz as the cutoff frequency, and extracts a low band signal of a waveform indicated by an arrow A33. In other words, the low pass filter 21 passes only the frequency component of 24 kHz or lower of the input signal, and generates the low band signal.

The low band signal is a signal that has the same frequency characteristics as the original input signal at up to 24 kHz and has the sampling frequency that is four times the sampling frequency of the input signal. Thus, in this example, the sampling frequency of the low band signal is 192 kHz.

(Low Band Extraction Band-Pass Filter)

The low band extraction band-pass filter 23 performs a filter process on the input signal through the band-pass filters 31-1 to 31-N, and extracts the low band sub band signals serving as the signals of the sub bands of the low band. In other words, the band-pass filter 31 passes only a frequency component of a predetermined pass band at the low band side of the input signal through the filtering using the band-pass filter, and generates the low band sub band signal.

Figure 5:
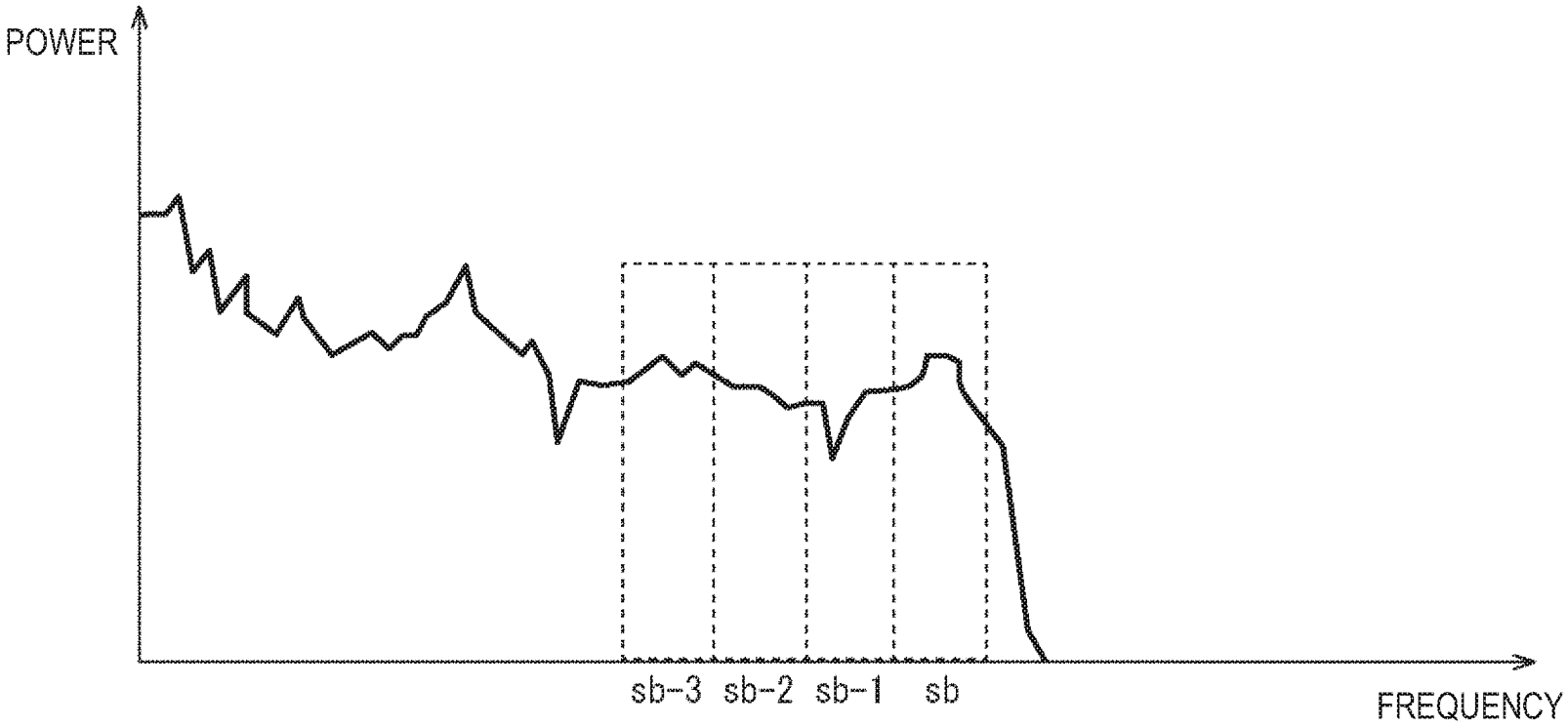
FIG. 5 is a diagram for describing division into sub bands.

As a result, for example, the signals of the four sub bands are obtained as the low band sub band signal as illustrated in FIG. 5. In FIG. 5, a vertical axis and a horizontal axis indicate power and a frequency of the input signal.

In this example, the number N of band-pass filters 31 is 4, and the low band sub band signal is obtained for each of four sub bands sb-3 to sb.

In other words, for example, one of 8 sub bands obtained by equally dividing the Nyquist frequency (24 kHz) of the input signal into 8 is used as the expansion start band, and 4 sub bands of the lower band than the expansion start band among the 8 sub bands are used as the pass bands of the band-pass filter 31.

Specifically, an index of a frequency band (sub band) closest to the expansion start band side in the low band, that is, a first sub band closest to the high band side is sb, and this sub band is hereinafter referred to as a "sub band sb." For example, the sub band sb is the pass band of the band-pass filter 31-1.

An index of a sub band adjacent to the sub band sb at the low band side is sb-1, and this sub band is hereinafter referred to as a "sub band sb-1." Similarly, an index of a sub band adjacent to the sub band sb-1 at the low band side is sb-2, and an index of a sub band adjacent to the sub band sb-2 at the low band side is sb-3.

Hereinafter, a sub band having an index of sb-2 and a sub band having an index of sb-3 are referred to as a "sub band sb-2" and a "sub band sb-3," respectively. For example, the sub bands sb-1 to sb-3 are the pass bands of the band-pass filters 31-2 to 31-4.

(Feature Quantity Calculation Circuit and High Band Sub Band Power Estimation Circuit)

Further, the feature quantity calculation circuit 24 calculates the feature quantity using at least one of the input signal and the low band sub band signal.

For example, power of the low band sub band signal is calculated as the feature quantity for each of the sub bands (hereinafter, also referred to as "low band sub bands") of the low band. Hereinafter, the power (level) of the sub band signal is also referred to as a "sub band power," and particularly, the power of the low band sub band signal also referred to as a "low band sub band power."

Specifically, the feature quantity calculation circuit 24 calculates low band sub band power power(ib,J) in a predetermined time frame J from a low band sub band signal x(ib,n) by calculating the following Formula (1). Here, ib indicates an index of a sub band, and n indicates an index of a discrete time. The number of samples of one frame is indicated by FSIZE, and power is indicated in decibels (db).

[Math 1]

$$\text{power}(ib, J) = 10\ \log10\left\{\left(\sum_{n=J\times FSIZE}^{(J+1)FSIZE-1} \times(ib, n)^2\right) \Big/ FSIZE\right\} \quad (1)$$

$$(sb-3 \le ib \le sb)$$

The low band sub band power power(ib,J) calculated for the four low band sub bands sb to sb−3 as described above is supplied from the feature quantity calculation circuit 24 to the high band sub band power estimation circuit 25 as the feature quantity of the input signal.

The high band sub band power estimation circuit 25 calculates an estimate value of power of a sub band signal of a band (a feature expansion band) that is desired to be expanded and subsequent to a sub band (the expansion start band) having an index of sb+1 based on the four pieces of low band sub band power supplied from the feature quantity calculation circuit 24.

Hereinafter, the sub band of the high band is also referred to as a "high band sub band." The sub band power of the high band sub band signal is also referred to as "high band sub band power." Further, the estimate value of the high band sub band power is also referred to as "quasi-high band sub band power."

Specifically, the high band sub band power estimation circuit 25 estimates quasi-high band sub band power $power_{est}(ib,J)$ by calculating the following Formula (2) on sub bands having indices of sb+1 to eb when an index of the highest sub band of the feature expansion band is eb.

[Math 2]

$$\text{power}_{est}(ib, j) = \left( \sum_{kb=sb-3}^{sb} \{A_{ib}(kb)\text{power}(kb, J)\} \right) + B_{ib} \quad (2)$$

$$(sb + 1 \le ib \le eb)$$

In Formula (2), a coefficient $A_{ib}(kb)$ and a coefficient $B_{ib}$ are coefficients having different values for respective sub bands ib of the high band, and the coefficient $A_{ib}(kb)$ and the coefficient $B_{ib}$ are obtained in advance by statistical learning so that appropriate values are obtained for various input signals.

For example, the coefficient $A_{ib}(kb)$ and the coefficient $B_{ib}$ are obtained in advance by regression analysis using a least-square technique in which the low band sub band power is used as an explanatory variable, and the high band sub band power is used as an explained variable.

Here, the high band sub band power is power of the high band sub band signal of the original signal before the input signal is obtained by removing the high band component. Thus, the quasi-high band sub band power is the estimate value of the high band sub band power of each high band sub band of the high band component removed from the original signal.

In this example, the quasi-high band sub band power is calculated by a primary linear combination of each low band sub band power, but the present technology is not limited thereto, and the quasi-high band sub band power may be calculated by any other method. For example, the quasi-high band sub band power may be calculated using a linear combination of a plurality of pieces of low band sub band power of several frames before and after the time frame J or may be calculated using a non-linear function.

The high band sub band power estimation circuit 25 supplies the quasi-high band sub band power of the high band sub bands obtained as described above to the band-pass filter calculation circuit 72.

(Band-Pass Filter Calculation Circuit)

Then, the band-pass filter calculation circuit 72 calculates band-pass filter coefficients h_env(ib,I) of the band-pass filters having the respective high band sub bands as the pass band based on the quasi-high band sub band power of a plurality of high band sub bands supplied from the high band sub band power estimation circuit 25.

Specifically, the band-pass filter calculation circuit 72 calculates a band-pass filter coefficient h_env(ib,I) by calculating the following Formula (3). In other words, in the calculation of Formula (3), the band-pass filter coefficient h_env(ib,I) is calculated by multiplying the band-pass filter coefficients h_org(ib,I) of the respective high band sub bands that are prepared in advance by a gain amount G(ib,J) obtained by the following Formula (4).

[Math 3]

$$h_\text{env}(ib,I) = h_\text{org}(ib,I) \times G(ib,J)$$

$$(sb+1 \le ib \le eb) \quad (3)$$

[Math 4]

$$G(ib,J) = 10^{power_{est}(ib,J)}$$

$$(sb+1 \le ib \le eb) \quad (4)$$

In Formula (3), ib, and J indicate an index of each respective high band sub band and an index of a time frame.

Further, I is an index indicating a sample of a time signal multiplied by a band-pass filter coefficient h_org(ib,I) (the band-pass filter coefficient h_env(ib,I)). Thus, for one high band sub band, the band-pass filter coefficients h_env(ib,I) that correspond to the number of samples indicated by the index I, that is, the number of taps configuring a filter, are prepared, and one band-pass filter is configured with the band-pass filter coefficients.

The band-pass filters of the high band sub bands configured with the band-pass filter coefficients h_env(ib,I) are a Finite Impulse Response (FIR) filter.

The band-pass filter calculation circuit 72 first calculates the gain amount G(ib,J) according to the quasi-high band sub band power $power_{est}(ib,J)$ using Formula (4). In the calculation of Formula (3), the band-pass filter coefficient h_org(ib, I) that is prepared in advance appropriately undergoes gain adjustment according to the gain amount G(ib,J), and thus the band-pass filter coefficient h_env(ib,I) is obtained.

Figure 6:
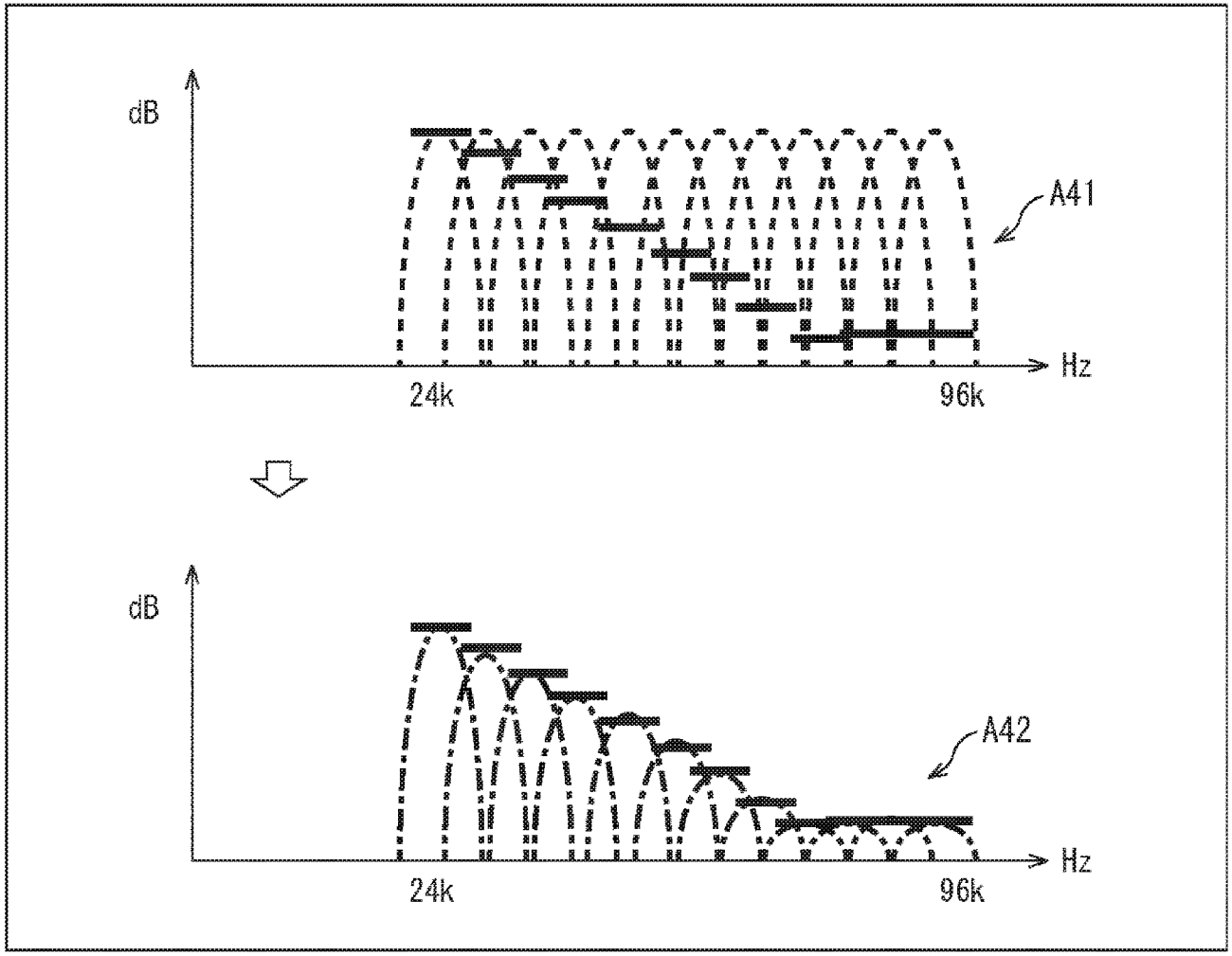
FIG. 6 is a diagram for describing generation of a band-pass filter coefficient.

Through the calculation of Formulas (3) and (4), the gain adjustment of the band-pass filter coefficient h_org(ib,I) is performed, for example, as illustrated in FIG. 6.

In FIG. 6, a vertical axis and a horizontal axis indicate power and a frequency of a signal.

In this example, a dotted line in a portion indicated by an arrow A41 indicates frequency characteristics of the band-pass filter coefficients h_org(ib,I) of the respective high band sub bands that are prepared in advance, and a solid line indicates the quasi-high band sub band power $power_{est}(ib,J)$ of the respective high band sub bands.

Here, the band-pass filter coefficient h_org(ib,I) and the quasi-high band sub band power $power_{est}(ib,J)$ positioned at the leftmost side indicate a band-pass filter coefficient h_org (sb+1,I) and quasi-high band sub band power $power_{est}(sb+1,J)$ of the high band sub band sb+1 positioned at the lowest band side. Further, the band-pass filter coefficient h_org(ib,I) and the quasi-high band sub band power $power_{est}(ib,J)$ positioned at the rightmost side indicate the band-pass filter coefficient h_org(eb,I) and the quasi-high band sub band power $power_{est}(eb,J)$ of the high band sub band eb positioned at the highest band side.

In this example, the band-pass filter coefficients h_org(ib, I) of the respective high band sub bands that are prepared in advance have frequency characteristics in which only the frequency of the pass band is different, but the other characteristics are the same. For this reason, in many high band sub bands, the maximum power of the band-pass filter coefficient h_org(ib,I) is higher than the quasi-high band sub band power.

In this regard, the gain adjustment is performed using the gain amount G(ib,J) obtained from the quasi-high band sub band power so that the maximum power of the band-pass filter coefficients h_org(ib,I) of the respective high band sub bands is suppressed up to the quasi-high band sub band power of the high band sub bands.

Thus, the band-pass filter coefficient h_env(ib,I) whose maximum power is the same as the quasi-high band sub band power is obtained as indicated by an arrow A42.

An alternate long and short dash line in a portion indicated by the arrow A42 indicates frequency characteristics of the band-pass filter coefficients h_env(ib,I) of the respective high band sub bands, and a solid line indicates the quasi-high band sub band power $power_{est}$(ib,J) of the high band sub bands.

The band-pass filter configured with the band-pass filter coefficients h_env(ib,I) obtained as described above functions as a filter for forming the waveform of the high band component. In other words, using the band-pass filter coefficients h_env(ib,I), it is possible to obtain the high band signal having the waveform of the high band component represented by the quasi-high band sub band power, that is, the waveform of the high band obtained by estimation.

The band-pass filter calculation circuit 72 supplies the band-pass filter coefficients h_env(ib,I) obtained for the respective high band sub band to the band-pass filters 81 of the respective high band sub bands. In this example, since the high band sub bands sb+1 to eb are the high band sub band, the number M of band-pass filters 81 is (eb-sb).

(Flattening Circuit, Down-Sampling Unit, and Up-Sampling Unit)

The flattening circuit 73 calculates the low band sub band power power(ib,J) by calculating Formula (1) based on the low band sub band signals x(ib,n) of a plurality of low band sub bands supplied from the band-pass filter 31.

Further, the flattening circuit 73 calculates a flattened signal x_flat(n) by calculating the following Formula (5) based on the low band sub band signals x(ib,n) and the low band sub band power power(ib,J) of the respective low band sub bands, and supplies the flattened signal x_flat(n) to the down-sampling unit 74.

[Math 5]

$$\text{x_flat}(n) = \sum_{ib=sb-3}^{sb} \{x(ib, n) \times 10^{(power(sb,J)-power(ib,J))/20}\} \quad (5)$$

$$(J \times FSIZE \leq n \leq (J+1) \times FSIZE - 1)$$

In Formula (5), level adjustment (flattening) of the low band sub band signals of the respective low band sub bands is performed, the respective low band sub band signals that have undergone the level adjustment are added, and the flattened signal x_flat(n) serving as one time signal is obtained.

Then, the down-sampling unit 74 performs ½ thinning sampling on the flattened signal x_flat(n) supplied from the flattening circuit 73, and generates a down-sampled flattened signal having a sampling frequency that is half that of the input signal.

In this example, since the sampling frequency of the input signal is 48 kHz, the sampling frequency of the down-sampled flattened signal is 24 kHz. The down-sampling unit 74 supplies the down-sampled flattened signal to the up-sampling unit 75.

Further, the up-sampling unit 75 inserts seven zeros, that is, 7 samples in which a sample value is 0, between samples for the data series of the down-sampled flattened signal supplied from the down-sampling unit 74.

As a result, the up-sampling is performed so that the sampling frequency of the flattened signal supplied from the down-sampling unit 74 is octupled. Since the sampling frequency of the down-sampled flattened signal supplied from the down-sampling unit 74 is 24 kHz, the sampling frequency of the up-sampled flattened signal is 192 kHz (=24 kHz×8).

Thus, the flattened signal having the sampling frequency that is four times that of the input signal is consequently obtained. In this example, since the sampling frequency of the input signal is 48 kHz, the up-sampled flattened signal has the sampling frequency that is four times the sampling frequency of the input signal.

The up-sampling unit 75 supplies the up-sampled flattened signal to the band-pass filters 81 of the level adjustment band-pass filter 76.

Figure 7:
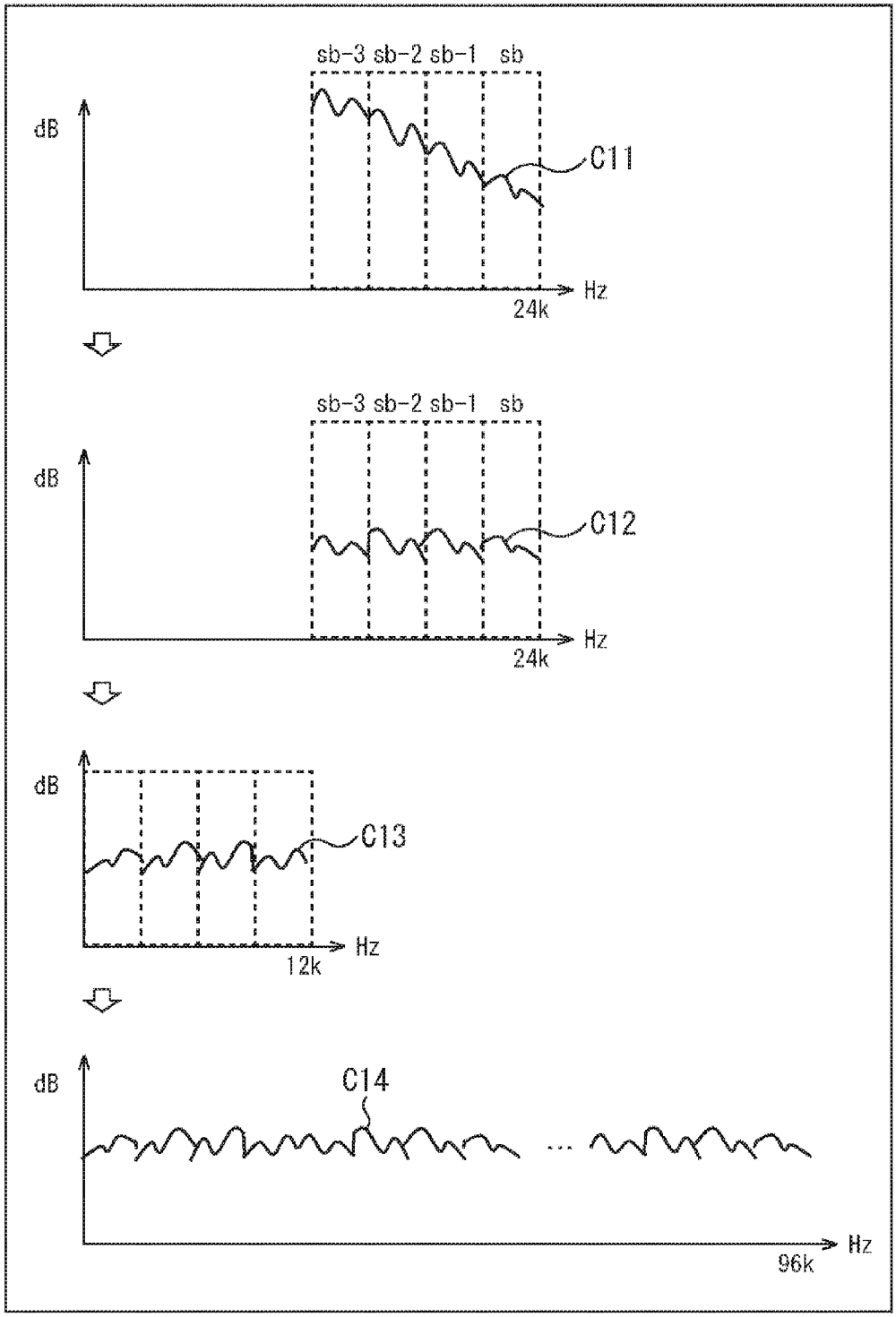
FIG. 7 is a diagram for describing generation and up-sampling of a flattened signal.

Through the process described above, a flattened signal illustrated in FIG. 7 is obtained. In FIG. 7, a vertical axis and a horizontal axis indicate power and a frequency of a signal.

For example, a low band sub band signal of a waveform indicated by a curve C11 in the top portion in FIG. 7 is supplied to the flattening circuit 73. In this example, the powers (levels) of the low band sub band signals of the respective low band sub bands are different from one another, and as the band is lower, the power increases. In other words, the waveform in which the power gently decreases in the high band direction is obtained.

The flattening circuit 73 obtains one flattened signal x_flat(n) by adjusting and adding the power (levels) of the low band sub band signals of the four sub bands sb to sb−3. A waveform of the flattened signal x_flat(n) obtained as described above is indicated by a curve C12 at a second position from the top in FIG. 7.

In this example, the power of the low band sub band signals is adjusted so that the power (levels) of the sub bands sb−1 to sb−3 is substantially the same as the power (level) of the sub band sb at the highest band side. In other words, flattening is performed so that the respective frequency bands of the signal of the low band component configured with the low band sub band signals of the four low band sub bands have substantially the same power.

The sampling frequency of the flattened signal x_flat(n) is 48 kHz. Since the frequency band expanding device 61 tries to finally obtain the signal of 192 kHz obtained by quadrupling 48 kHz serving as the sampling frequency of the input signal, in order to generate the high band signal, it is necessary to set the sampling frequency of the flattened signal used for generation of the high band signal to 192 kHz.

However, the flattened signal x_flat(n) obtained at a current point in time substantially includes only a component between the sub band sb and the sub band sb-3. In other words, the flattened signal x_flat(n) does not substantially include a component of a frequency lower than the sub band sb−3.

For this reason, if the up-sampling of quadrupling the sampling frequency is simply performed on the flattened signal of the waveform indicated by the curve C12, a signal having a frequency band in which the frequency component is not substantially included is obtained.

In this regard, the frequency band expanding device 61 first performs down-sampling on the flattened signal and then performs up-sampling the down-sampled flattened signal as indicated by a third diagram from the top in FIG. 7. As a result, the flattened signal having the sampling frequency of 192 kHz in which the power of each frequency band is constant, that is, the waveform is flat, is obtained as indicated by a fourth diagram from the top in FIG. 7.

In other words, when the down-sampling is performed on the flattened signal x_flat(n) indicated by the curve C12, a waveform of the flattened signal obtained as a result becomes a waveform indicated by a curve C13. In this example, the waveform indicated by the curve C13 obtained by the down-sampling becomes a waveform of a shape in which the waveform indicated by the curve C12 is replicated on the low band side at the position of 12 kHz.

Thus, as the up-sampling is performed on the flattened signal of the waveform indicated by the curve C13, that is, the down-sampled flattened signal, mirroring (frequency aliasing) is performed seven times based on the waveform indicated by the curve C13, and a flattened signal of a waveform indicated by a curve C14 is obtained.

The waveform indicated by the curve C14 is a flat waveform in which the power of the respective frequencies from 0 kHz to 96 kHz is substantially constant.

Particularly, since the flattening circuit 73 performs the flattening according to the power of the sub band sb at the highest frequency side, the power of the respective frequencies of the flattened signal of the waveform indicated by the curve C14 that is finally obtained is substantially equal to the power of the low band sub band signal of the original sub band sb. In other words, the power of the respective frequencies of the flattened signal of the waveform indicated by the curve C14 that is finally obtained is substantially equal to the power of the sub band sb of the original input signal.

Thus, when the high band signal is generated using the flattened signal of the waveform indicated by the curve C14, it is possible to cause the power of the sub band sb+1 adjacent to the sub band sb in the obtained high band signal to be substantially equal to the power of the sub band sb of the original input signal, that is, the low band signal, and when the low band signal is added to the high band signal, the waveform of the high band can be smoothly connected with the waveform of the low band. As a result, the output signal of the more natural waveform can be obtained.

(Level Adjustment Band-Pass Filter and Addition Unit)

Next, the level adjustment band-pass filter 76, the addition unit 77, and the addition unit 28 will be described.

The level adjustment band-pass filter 76 performs filtering using the band-pass filter coefficient supplied from the band-pass filter calculation circuit 72 on the up-sampled flattened signal supplied from the up-sampling unit 75, and generates a plurality of high band sub band signals.

Specifically, filtering is performed on the flattened signal using the band-pass filter coefficient h_env(ib,l) having an index ib (here, sb+1≤ib≤eb) of the sub band for each high band sub band, and thus a high band sub band signal of a high band sub band ib is generated. As a result, the high band sub band signals of the high band sub bands sb+1 to eb are obtained.

The addition unit 77 generates one high band signal by adding the high band sub band signals of a plurality of high band sub bands obtained as described above, and supplies the generated high band signal to the high pass filter 27. Then, the high pass filter 27 removes the low band component from the high band signal, and then supplies the resulting signal to the addition unit 28.

The low band signal and the high band signal having the sampling frequency that is four times that of the input signal, that is, the sampling frequency of 192 kHz, are supplied from the delay circuit 22 and the high pass filter 27 to the addition unit 28. The addition unit 28 obtains an output signal by adding the low band signal to the high band signal, and outputs the obtained output signal.

Through the above process, the frequency band expanding device 61 can perform the band expansion by up-sampling the input signal in which the sampling frequency is 48 kHz to 192 kHz, that is, four times the sampling frequency.

Further, by changing the number of inserted zeros in the up-sampling and the number of thinned samples in the down-sampling, up-sampling and band expansion by a factor of a power of 2 such as 2, 8, or 16 can be implemented.

<Exemplary Configuration of Frequency Band Expanding Device>

Meanwhile, according to the technique of combining the frequency band expanding device 11 with the up-sampling or the frequency band expanding device 61 illustrated in FIG. 3, the output signal of the high resolution of the high sampling frequency can be obtained from the input signal of the standard resolution. However, in this technique, the processing amount increases according to the ratio of the sampling frequency of the input signal and the sampling frequency of the output signal.

For example, when the frequency band expanding device 11 performs the frequency band expansion process after the sampling frequency of the input signal is up-sampled by a factor of four, the processing amount becomes four times that when the frequency band expansion process is performed without performing the up-sampling. Even in the frequency band expanding device 61, the amount of processing in the level adjustment band-pass filter 76 increases according to the ratio of the sampling frequency of the input signal and the sampling frequency of the output signal. In this case, it may be hard to perform processing through a central processing unit (CPU) or a digital signal processor (DSP) in which an operation frequency is insufficient.

Figure 8:
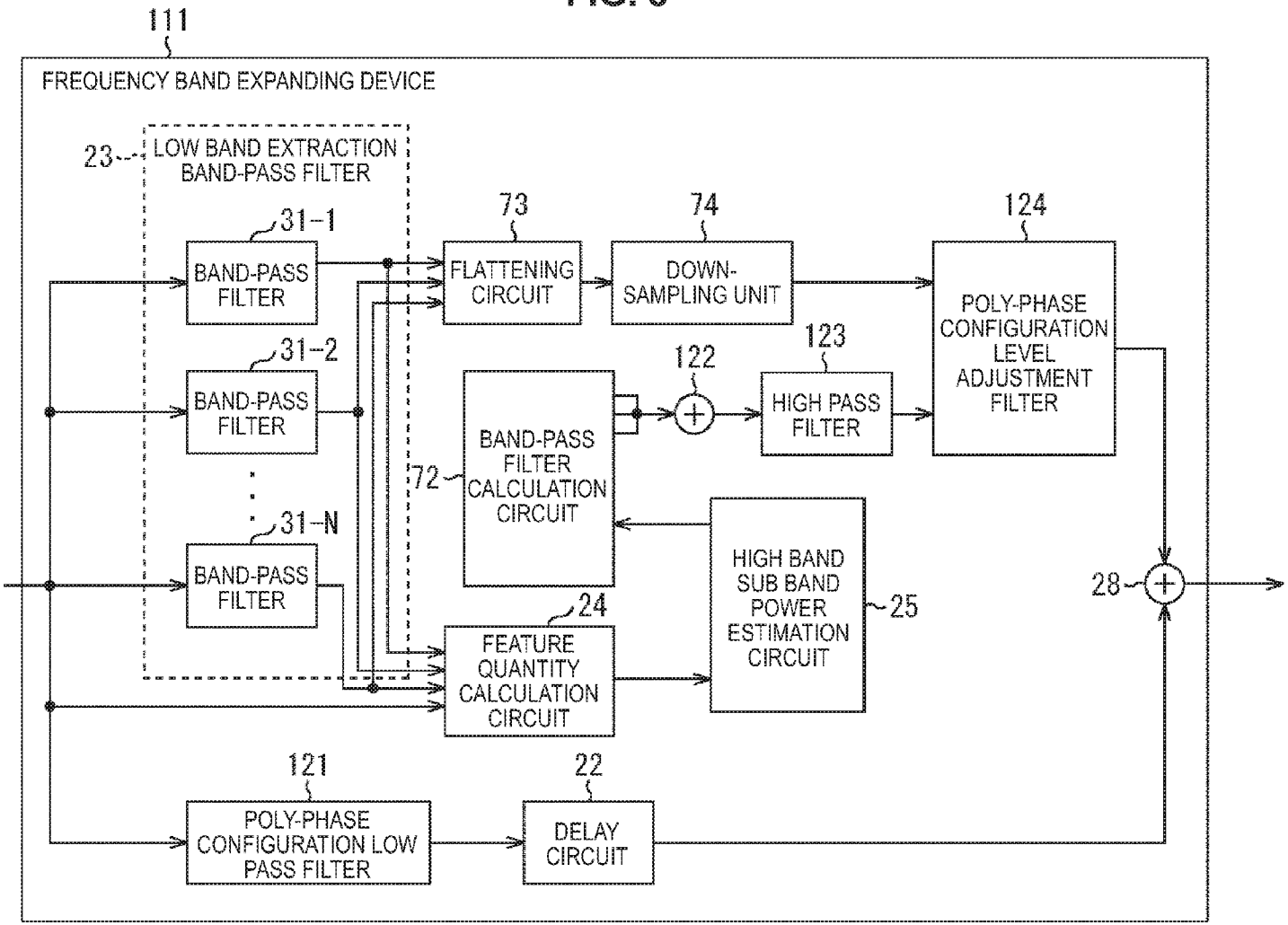
FIG. 8 is a diagram illustrating a configuration of a frequency band expanding device to which the present technology is applied.

In this regard, in the present technology, the frequency band expanding device employs a configuration illustrated in FIG. 8, and thus it is possible to obtain high-quality sound, that is, high resolution sound, with a small processing amount. In FIG. 8, portions corresponding to those in FIG. 3 are denoted by the same reference numerals, and a description thereof is appropriately omitted.

A frequency band expanding device 111 illustrated in FIG. 8 performs a process equivalent to the process performed by the frequency band expanding device 61 with a smaller processing amount than in the frequency band expanding device 61. The frequency band expanding device 111 performs band expansion by up-sampling the sampling frequency of the input signal by a factor of a power of 2.

Next, the configuration of the frequency band expanding device 111 will be described, and a technique by which the processing amount can be reduced by enabling the configuration of the frequency band expanding device 61 to be changed to be equivalent to the configuration of the frequency band expanding device 111 will be described.

Here, an example in which the band expansion is performed such that the input signal of the sampling frequency of 48 kHz is up-sampled to the quadruple sampling frequency, that is, 192 kHz, will be described.

The frequency band expanding device 111 illustrated in FIG. 8 includes a poly-phase configuration low pass filter 121, a delay circuit 22, a low band extraction band-pass filter 23, a feature quantity calculation circuit 24, a high band sub band power estimation circuit 25, a band-pass filter calculation circuit 72, an addition unit 122, a high pass filter 123, a flattening circuit 73, a down-sampling unit 74, a poly-phase configuration level adjustment filter 124, and an addition unit 28.

The configuration of the frequency band expanding device 111 differs from the configuration of the frequency band expanding device 61 in the following point.

In other words, in the frequency band expanding device 111, the up-sampling unit 71 and the low pass filter 21 arranged in the frequency band expanding device 61 are replaced with the poly-phase configuration low pass filter 121.

Further, in the frequency band expanding device 111, the up-sampling unit 75 and the level adjustment band-pass filter 76 arranged in the frequency band expanding device 61 are replaced with the poly-phase configuration level adjustment filter 124.

Furthermore, in the frequency band expanding device 61, the addition unit 77 and the high pass filter 27 are arranged between the level adjustment band-pass filter 76 and the addition unit 28.

On the other hand, the addition unit 122 and the high pass filter 123 of the frequency band expanding device 111 corresponding to the addition unit 77 and the high pass filter 27 are arranged between the band-pass filter calculation circuit 72 and the poly-phase configuration level adjustment filter 124. In other words, an order of processing is changed by changing the arrangement position.

Next, the reduction in the processing amount while performing the equivalent process through the above replacement and the change of the arrangement position will be described.

First, the replacement with the poly-phase configuration low pass filter 121 will be described.

The low pass filter 21 of the frequency band expanding device 61 performs the filtering on the signal output from the up-sampling unit 71, but the signal is the signal in which the three zeros are inserted between every two of the samples of the data series of the input signal as described above.

Here, if the low pass filter used for the filtering in the low pass filter 21 is a FIR filter, the insertion of the three zeros can be omitted from the filtering process, and thus the processing amount can be reduced.

In this regard, in the frequency band expanding device 111, the poly-phase configuration low pass filter 121 is arranged to perform the up-sampling of the input signal and the low-pass filtering process at the same time. In other words, in the poly-phase configuration low pass filter 121, the up-sampled low band signal can be obtained by performing the filtering on the input signal using the poly-phase configuration filter, and thus the processing amount can be reduced.

Further, the poly-phase configuration low pass filter 121 can perform up-sampling by a factor of a power of two on the sampling frequency.

Next, the replacement with the poly-phase configuration level adjustment filter 124 and the change of the arrangement position of the addition unit 122 and the high pass filter 123 will be described.

In the frequency band expanding device 61, the high band sub band signals of the respective high band sub bands obtained by the filtering performed by the level adjustment band-pass filter 76 are added by the addition unit 77.

Here, the level adjustment band-pass filter 76, that is, the band-pass filter used in the band-pass filter 81 is a FIR filter.

In this case, due to linearity thereof, the output of the addition unit 77 is the same as the output obtained by filtering the flattened signal using the filter coefficient obtained by adding the band-pass filter coefficients of the band-pass filters 81-1 to 81-M in advance.

In the frequency band expanding device 111, the process of adding the band-pass filter coefficients h_env(ib,I) of the band-pass filters 81-1 to 81-M in advance is performed by the addition unit 122.

Further, in the frequency band expanding device 61, the output of the addition unit 77 is filtered by the high pass filter in the high pass filter 27. The output of the addition unit 77 corresponds to the output obtained by filtering using the band-pass filter coefficient obtained by the addition of the addition unit 122 in the frequency band expanding device 111.

Here, the high pass filter used in the high pass filter 27 is also a FIR filter. In this case, due to linearity thereof, the high band signal output from the high pass filter 27 is the same as an output obtained by filtering using the filter coefficient obtained by filtering the band-pass filter coefficient obtained by the addition of the addition unit 122 in advance through the high pass filter.

In this regard, in the frequency band expanding device 111, the process of filtering the band-pass filter coefficient obtained by the addition of the addition unit 122 in advance through the high pass filter is performed by the high pass filter 123.

Lastly, when the up-sampling is performed by inserting seven zeros between every two of the samples of the data series of the flattened signal serving as the output of the down-sampling unit 74 of the frequency band expanding device 111, and the output is filtered using the filter coefficient output from the high pass filter 123, the process equivalent to the process performed by the frequency band expanding device 61 can be performed.

In the up-sampling and the filter process, the filtering process for the insertion of the seven zeros can be omitted, similarly to the time of the generation of the low band signal, and thus the processing amount can be reduced.

In this regard, in the frequency band expanding device 111, the poly-phase configuration level adjustment filter 124 is arranged to perform the up-sampling of the flattened signal and the high-pass filtering process at the same time. In other words, the poly-phase configuration level adjustment filter 124 can obtain the up-sampled high band signal by filtering the flattened signal using the poly-phase configuration filter, and thus the processing amount can be reduced.

The poly-phase configuration level adjustment filter 124 can perform only up-sampling by an integer multiple of the sampling frequency.

As described above, according to the frequency band expanding device 111, the processing amount can be reduced while performing the process equivalent to the process performed by the frequency band expanding device 61. In other words, even when the band expansion is performed by up-sampling the sampling frequency of the input signal by a factor of four, the high resolution sound can be reduced with substantially the same processing amount as when the band expansion is performed without performing the up-sampling.

<Exemplary Configuration of Poly-Phase Configuration Level Adjustment Filter>

Figure 9:
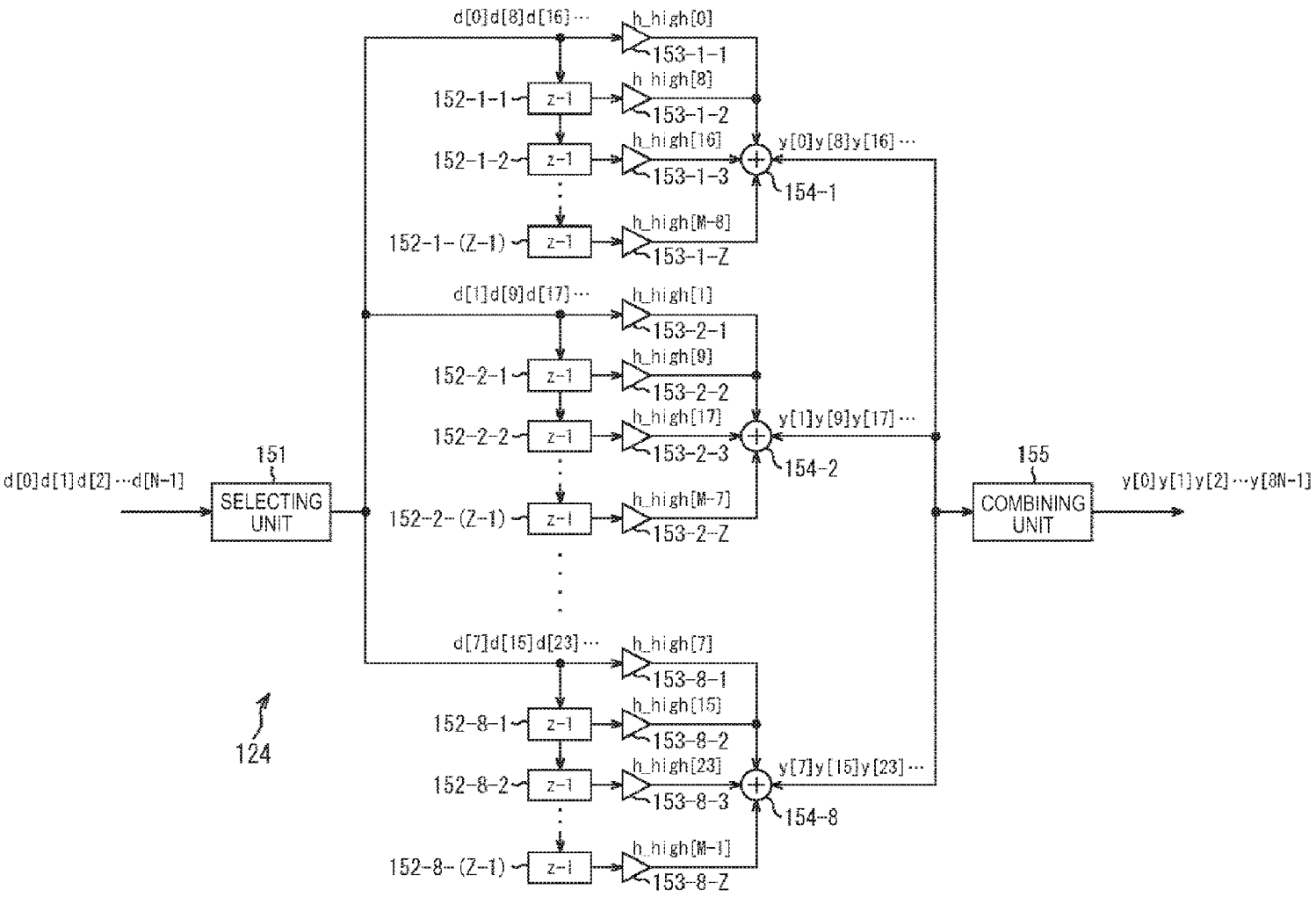
FIG. 9 is a diagram illustrating an exemplary configuration of a poly-phase configuration level adjustment filter.

The poly-phase configuration level adjustment filter 124 of the frequency band expanding device 111 illustrated in FIG. 8 employs, for example, the configuration illustrated in FIG. 9.

The poly-phase configuration level adjustment filter 124 illustrated in FIG. 9 includes a selecting unit 151, delay units 152-1-1 to 152-8-(Z−1), amplifying units 153-1-1 to 153-8-Z, addition units 154-1 to 154-8, and a combining unit 155.

Here, some blocks such as the delay units 152-3-1 to 152-7-(Z-1), the amplifying units 153-3-1 to 153-7-Z, the addition units 154-3 to 154-7, and the like are not illustrated. Further, a series of samples of the flattened signal supplied from the down-sampling unit 74 to the poly-phase configuration level adjustment filter 124 is assumed to be d[0], d[1], . . . , and d[N−1]. Furthermore, M filter coefficients output from the high pass filter 123 are h_high[m] (here, m=0, 1, 2, . . . , and M−1), and M is assumed to be a multiple of 8.

The selecting unit 151 supplies the samples of the flattened signal supplied from the down-sampling unit 74 to any one of the delay unit 152-1-1, the delay unit 152-2-1, the delay unit 152-3-1, the delay unit 152-4-1, the delay unit 152-5-1, the delay unit 152-6-1, the delay unit 152-7-1, and the delay unit 152-8-1. For example, the delay unit 152-1-1 to the delay unit 152-8-1 are sequentially selected, and after the delay unit 152-8-1 is selected, the delay unit 152-1-1 is selected again. Then, one sample is sequentially supplied to the selected delay unit.

Thus, for example, d[0], d[8], d[16], . . . are sequentially supplied to the delay unit 152-1-1 as the samples of the flattened signal.

Further, the selecting unit 151 supplies the samples of the flattened signal supplied from the down-sampling unit 74 to any one of the amplifying unit 153-1-1, the amplifying unit 153-2-1, the amplifying unit 153-3-1, the amplifying unit 153-4-1, the amplifying unit 153-5-1, the amplifying unit 153-6-1, the amplifying unit 153-7-1, and the amplifying unit 153-8-1. For example, the amplifying unit 153-1-1 to the amplifying unit 153-8-1 are sequentially selected, and after the amplifying unit 153-8-1 is selected, the amplifying unit 153-1-1 is selected again. Then, one sample is sequentially supplied to the selected amplifying unit.

Thus, for example, d[0], d[8], d[16], . . . are sequentially supplied to the amplifying unit 153-1-1 as the samples of the flattened signal.

The delay unit 152-1-1 supplies one sample of the flattened signal supplied from the selecting unit 151, specifically, the sample value of the same, to the amplifying unit 153-1-2 and the delay unit 152-1-2.

The delay unit 152-1-Q (here, 2≤Q≤Z−2) supplies one sample of the flattened signal supplied from the delay unit 152-1-(Q−1) to the amplifying unit 153-1-(Q+1) and the delay unit 152-1-(Q+1). The delay unit 152-1-(Z−1) supplies one sample of the flattened signal supplied from the delay unit 152-1-(Z−2) to the amplifying unit 153-1-Z.

Hereinafter, when it is unnecessary to distinguish the delay units 152-1-1 to 152-1-(Z−1) particularly, they are also referred to simply as a "delay unit 152-1." Here, Z=M/8 is set.

The amplifying unit 153-1-1 multiplies one sample of the flattened signal supplied from the selecting unit 151 by a filter coefficient h_high[0] supplied from the high pass filter 123, and supplies the resulting data to the addition unit 154-1.

The amplifying unit 153-1-Q (here, 2≤Q≤Z) multiplies one sample of the flattened signal supplied from the delay unit 152-1-(Q−1) by a filter coefficient h_high[8Q−8] supplied from the high pass filter 123, and supplies the resulting data to the addition unit 154-1.

Hereinafter, when it is unnecessary to distinguish the amplifying units 153-1-1 to 153-1-Z particularly, they are also referred to simply as an "amplifying unit 153-1."

The addition unit 154-1 adds the samples multiplied by the filter coefficient which are supplied from the amplifying units 153-1-1 to 153-1-Z, and supplies the sample obtained as a result to the combining unit 155 as one sample of the high band signal.

For example, when a series of samples of the high band signal is assumed to be y[0], y[1], . . . , and y[8N−1], as the samples of the high band signal, y[0], y[8], y[16], . . . are sequentially output from the addition unit 154-1.

Further, the delay unit 152-R−1 (here, 2≤R≤8) supplies one sample of the flattened signal supplied from the selecting unit 151 to the amplifying unit 153-R-2 and the delay unit 152-R−2.

The delay unit 152-R-Q (here, 2≤R≤8 and 2≤Q≤Z−2) supplies one sample of the flattened signal supplied from the delay unit 152-R-(Q−1) to the amplifying unit 153-R-(Q+1) and the delay unit 152-R-(Q+1). Further, the delay unit 152-R-(Z−1) supplies one sample of the flattened signal supplied from the delay unit 152-R-(Z−2) to the amplifying unit 153-R-Z.

Hereinafter, when it is unnecessary to distinguish the delay units 152-R-1 to 152-R-(Z−1) (here, 2≤R≤8) particularly, they are also referred to simply as a "delay unit 152-R." Further, when it is unnecessary to distinguish the delay units 152-1 to 152-8 particularly, they are also referred to simply as a "delay unit 152."

The amplifying unit 153-R−1 (here, 2≤R≤8) multiplies one sample of the flattened signal supplied from the selecting unit 151 by a filter coefficient h_high[R−1] supplied from the high pass filter 123, and supplies the resulting data to the addition unit 154-R.

The amplifying unit 153-R-Q (here, 2≤R≤8 and 2≤Q≤Z) multiplies one sample of the flattened signal supplied from the delay unit 152-R-(Q−1) by a filter coefficient h_high [8Q+R−9] supplied from the high pass filter 123, and supplies the resulting data to the addition unit 154-R.

Hereinafter, when it is unnecessary to distinguish the amplifying units 153-R−1 to 153-R-Z (here, 2≤R≤8) particularly, they are also referred to simply as an "amplifying unit 153-R." Further, hereinafter, when it is unnecessary to distinguish the amplifying units 153-1 to 153-8 particularly, they are also referred to simply as an "amplifying unit 153."

The addition unit 154-R (here, 2≤R≤8) adds the samples multiplied by the filter coefficient which are supplied from the amplifying units 153-R−1 to 153-R-Z, and supplies the sample obtained as a result to the combining unit 155 as one sample of the high band signal.

For example, y[R−1], y[R+7], y[R+15], . . . are sequentially output from the addition unit 154-R (here, 2≤R≤8) as the samples of the high band signal. Hereinafter, when it is unnecessary to distinguish the addition units 154-1 to 154-8 particularly, they are also referred to simply as an "addition unit 154."

The combining unit 155 sequentially outputs the samples supplied from the addition units 154-1 to 154-8 one by one as the samples of the high band signal.

For example, the combining unit 155 sequentially output the samples supplied from the addition units 154-1 to 154-8 one by one, then outputs the sample supplied from the addition unit 154-1 again, and then similarly outputs the sample supplied from the addition unit 154.

As a result, y[0], y[1], . . . , and y[8N−1] are output to the addition unit 28 as a series of samples of the high band signal. In other words, the up-sampling of the signal is performed so that the sampling frequency of the high band signal is eight times the sampling frequency of the original flattened signal serving as the input signal.

The poly-phase configuration low pass filter 121 of the frequency band expanding device 111 illustrated in FIG. 8 has a similar configuration to the poly-phase configuration level adjustment filter 124. Here, the poly-phase configuration low pass filter 121 is configured to perform up-sampling to obtain a signal having a sampling frequency that is four times that of the original signal.

<Description of Frequency Band Expansion Process>

Next, the frequency band expansion process performed by the frequency band expanding device 111 will be described with reference to the flowchart of FIG. 10.

In step S11, the poly-phase configuration low pass filter 121 performs filtering on the supplied input signal using the poly-phase configuration low pass filter, and supplies the low band signal obtained as a result to the delay circuit 22. Through the filtering, up-sampling of the signal and extraction of the low band component are performed, and thus the low band signal is obtained.

In step S12, the delay circuit 22 appropriately delays the low band signal supplied from the poly-phase configuration low pass filter 121, and then supplies the low band signal to the addition unit 28.

In step S13, the low band extraction band-pass filter 23 divides the supplied input signal into a plurality of low band sub band signals.

Specifically, the band-pass filters 31-1 to 31-N perform the filtering on the input signal using the band-pass filters corresponding to the respective sub bands of the low band, and supply the low band sub band signals obtained as a result to the feature quantity calculation circuit 24 and the flattening circuit 73. As a result, for example, the respective low band sub band signals of the low band sub bands sb−3 to sb are obtained.

In step S14, the feature quantity calculation circuit 24 calculates the feature quantity using at least one of the supplied input signal and the low band sub band signal supplied from the band-pass filter 31, and supplies the feature quantity to the high band sub band power estimation circuit 25.

For example, the feature quantity calculation circuit 24 calculates the low band sub band power power(ib,J) for the low band sub bands sb to sb−3 as the feature quantity by calculating Formula (1).

In step S15, the high band sub band power estimation circuit 25 calculates the quasi-high band sub band power serving as the estimate value of the high band sub band power of each high band sub band based on the feature quantity supplied from the feature quantity calculation circuit 24, and supplies the quasi-high band sub band power to the band-pass filter calculation circuit 72.

For example, the high band sub band power estimation circuit 25 calculates the quasi-high band sub band power $power_{est}(ib,J)$ for the high band sub bands sb+1 to eb by calculating Formula (2).

In step S16, the band-pass filter calculation circuit 72 calculates the band-pass filter coefficient based on the quasi-high band sub band power supplied from the high band sub band power estimation circuit 25, and then supplies the band-pass filter coefficient to the addition unit 122.

Specifically, the band-pass filter calculation circuit 72 calculates the band-pass filter coefficient h_env(ib,I) for the index of each sample for each high band sub band ib (here, sb+1≤ib≤eb) by calculating Formulas (3) and (4).

In step S17, the addition unit 122 obtains one filter coefficient by adding the band-pass filter coefficients supplied from the band-pass filter calculation circuit 72, and supplies the obtained filter coefficient to the high pass filter 123.

Specifically, the filter coefficient of the sample I is obtained by adding the band-pass filter coefficients h_env (ib,I) of the same samples (index) I of the respective high band sub bands ib. In other words, the band-pass filter coefficients h_env(sb+1,I) to h_env(eb,I) are added, and thus one filter coefficient is obtained.

One filter configured with the filter coefficients of the samples I obtained as described above is a poly-phase configuration filter used in the filter process performed by the poly-phase configuration level adjustment filter 124.

When one filter coefficient is obtained by adding a plurality of band-pass filter coefficients, and filtering is performed using the filter coefficient obtained as described above, a plurality of filter processes can be implemented by a single filter process. Accordingly, the processing amount can be reduced.

In step S18, the high pass filter 123 removes the low band component (noise) from the filter coefficient by performing filtering on the filter coefficient supplied from the addition unit 122 using the high pass filter, and supplies the filter coefficient obtained as a result to the amplifying unit 153 of the poly-phase configuration level adjustment filter 124. In other words, the high pass filter 123 passes only the high band component of the filter coefficient.

In step S19, the flattening circuit 73 generates the flattened signal by flattening and adding the low band sub band signals of the respective low band sub bands supplied from the band-pass filter 31, and supplies the flattened signal to the down-sampling unit 74.

Specifically, the flattening circuit 73 calculates the low band sub band power by calculating Formula (1), and further generates the flattened signal by calculating Formula (5) based on the obtained low band sub band power.

In step S20, the down-sampling unit 74 performs down-sampling on the flattened signal supplied from the flattening circuit 73, and supplies the down-sampled flattened signal to the selecting unit 151 of the poly-phase configuration level adjustment filter 124.

In step S21, the poly-phase configuration level adjustment filter 124 generates the high band signal by filtering the down-sampled flattened signal supplied from the down-sampling unit 74 using the filter coefficient supplied from the high pass filter 123.

Specifically, the selecting unit 151 of the poly-phase configuration level adjustment filter 124 supplies the samples of the down-sampled flattened signal supplied from the down-sampling unit 74 to any one of the delay units 152-1-1 to 152-8-1 sequentially. Further, the selecting unit 151 supplies the samples of the flattened signal supplied from the down-sampling unit 74 to any one of the amplifying units 153-1-1 to 153-8-1 sequentially.

Each delay unit 152 supplies the supplied sample to the amplifying unit 153 and the next delay unit 152, and the amplifying unit 153 multiplies the supplied sample by the filter coefficient supplied from the high pass filter 123, and supplies the resulting data to the addition unit 154. Then, the addition unit 154 adds the samples supplied from the amplifying units 153, and supplies the resulting data to the combining unit 155, and the combining unit 155 supplies the samples supplied from the addition units 154 to the addition unit 28 one by one in an appropriate order as the samples of the high band signal.

As described above, as the filtering is performed on the flattened signal using the poly-phase configuration filter, the up-sampling is performed at the same time as the adjustment of the levels of the frequency bands of the high band of the flattened signal, and the high band signal of the desired waveform is obtained.

In the poly-phase configuration level adjustment filter 124, the level adjustment is performed through the filtering on the flattened signal serving as the time signal, that is, in the time domain, and the high band signal is obtained, but the high band signal may be generated in the frequency domain.

In step S22, the addition unit 28 obtains the output signal by adding the low band signal supplied from the delay circuit 22 to the high band signal supplied from the poly-phase configuration level adjustment filter 124, and outputs the output signal to the subsequent stage. When the output signal is output, the frequency band expansion process ends.

As described above, the frequency band expanding device 111 performs the filtering on the input signal and the flattened signal through the poly-phase configuration filter, and performs the up-sampling of the signals at the same time as the generation of the low band signal and the high band signal. Further, the frequency band expanding device 111 obtains one filter coefficient by adding the band-pass filter coefficients of the high band sub bands in advance, and performs the filtering on the flattened signal.

As a result, high resolution sound can be obtained with a small processing amount. In other words, high-quality sound can be obtained with a small processing amount.

Second Embodiment

Noise Injection

The example in which the high band signal is generated using the low band component of the input signal has been described above. However, in this case, the high band signal may have an unnatural frequency shape. In other words, the high band signal having the unnatural frequency shape in which a fine frequency shape of the low band is included in the high band without change is likely to be generated. In this case, the audio quality of the sound of the output signal deteriorates. In order to obtain the high-quality sound, it is desirable that the high band have a frequency shape that is as flat as possible.

Figure 11:
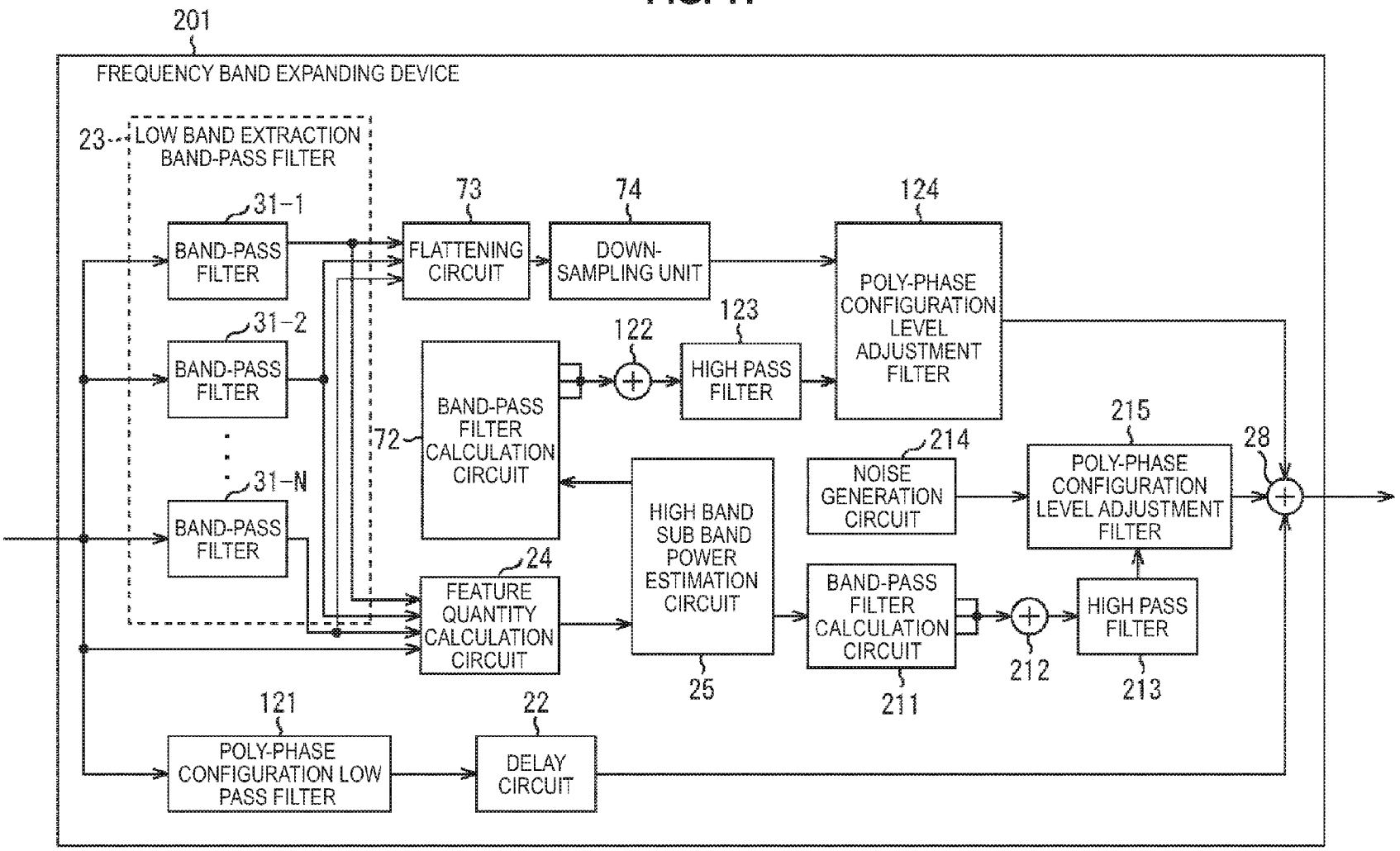
FIG. 11 is a diagram illustrating a configuration of a frequency band expanding device.

In this regard, in the present technology, the frequency band expanding device employs, for example, the configuration illustrated in FIG. 11, a high band noise signal is added to the high band signal, the frequency shape of the high band has a flatter shape, and thus high-quality sound can be obtained. In FIG. 11, portions corresponding to those in FIG. 8 are denoted by the same reference numerals, and a description thereof is appropriately omitted.

A frequency band expanding device 201 of FIG. 11 includes a poly-phase configuration low pass filter 121, a delay circuit 22, a low band extraction band-pass filter 23, a feature quantity calculation circuit 24, a high band sub band power estimation circuit 25, a band-pass filter calculation circuit 72, an addition unit 122, a high pass filter 123, a flattening circuit 73, a down-sampling unit 74, a poly-phase configuration level adjustment filter 124, a band-pass filter calculation circuit 211, an addition unit 212, a high pass filter 213, a noise generation circuit 214, a poly-phase configuration level adjustment filter 215, and an addition unit 28.

The frequency band expanding device 201 has a configuration in which the band-pass filter calculation circuit 211 to the poly-phase configuration level adjustment filter 215 are added to the configuration of the frequency band expanding device 111 illustrated in FIG. 8.

The band-pass filter calculation circuit 72, the addition unit 122, and the high pass filter 123 perform filter generation for forming the frequency shape of the high band signal, whereas the band-pass filter calculation circuit 211, the addition unit 212, and the high pass filter 213 perform filter generation for forming the frequency shape of the high band noise signal.

The band-pass filter calculation circuit 211 calculates the band-pass filter coefficient of the band-pass filter having each of the high band sub bands as the pass band based on the feature quantity supplied from the high band sub band power estimation circuit 25. The estimate value of the high band sub band power, that is, the quasi-high band sub band power is supplied to the band-pass filter calculation circuit 211, for example, as the feature quantity.

Specifically, the band-pass filter calculation circuit 211 calculates band-pass filter coefficients h_noise(ib,I) of the respective high band sub bands by calculating the following Formula (6). In other words, in the calculation of Formula (6), the band-pass filter coefficient h_noise(ib,I) is calculated by multiplying the band-pass filter coefficients h_org(ib,I) of the respective high band sub bands that are prepared in advance by a gain amount G_noise(ib,J) obtained by the following Formula (7).

[Math 6]

$$h_\mathrm{noise}(ib,I)=h_\mathrm{org}(ib,I)\times G_\mathrm{noise}(ib,J)$$

$$(sb+1\leq ib\leq eb) \tag{6}$$

[Math 7]

$$G_\mathrm{noise}(ib,J)=10^{(power_noise(ib,J)-power_noise_generated)/20}$$

$$(J\times F\mathrm{SIZE}\leq n\leq (J+1)\times F\mathrm{SIZE}-1),(sb+1\leq ib\leq eb) \tag{7}$$

In Formula (7), power_noise(ib,J) indicates power of noise to be added in each high band sub band, and the power power_noise(ib,J) of the noise is calculated, for example, through the following Formula (8).

[Math 8]

$$\mathrm{power_noise}(ib,J)=\mathrm{MAX}(-90,\mathrm{power}_{est}(ib,J)-60)$$

$$(J\times F\mathrm{SIZE}\leq n\leq (J+1)\times F\mathrm{SIZE}-1),(sb-1\leq ib\leq eb) \tag{8}$$

In Formula (8), a larger value of a value obtained by adding a predetermined value to the estimate value of the high band sub band power so that a predetermined signal to noise (SN) ratio is obtained and a lower limit value of the noise is regarded as the power power_noise(ib,J) of the noise. In this example, −60 dB is added as a value for obtaining a certain SN ratio, and the lower limit value of the noise is −90 dB.

Further, in Formula (7), power_noise_generated is a power value of white noise generated by the noise generation circuit 214 and is, for example, −90 (dB).

The addition unit 212 adds the band-pass filter coefficients supplied from the band-pass filter calculation circuit 211, and supplies the resulting band-pass filter coefficient to the high pass filter 213. The high pass filter 213 performs filtering on the filter coefficient supplied from the addition unit 212 using the high pass filter, and supplies the resulting data to the poly-phase configuration level adjustment filter 215.

The addition unit 212 and the high pass filter 213 perform the same processes as the addition unit 122 and the high pass filter 123, respectively.

The noise generation circuit 214 generates a white noise signal in which the sampling frequency is half that of the input signal, that is, 24 kHz, and the power value is power_noise_generated (for example, −90 dB) through random number generation of a uniform distribution, and supplies the white noise signal to the poly-phase configuration level adjustment filter 215.

The poly-phase configuration level adjustment filter 215 performs filtering on the white noise signal supplied from the noise generation circuit 214 using the filter coefficient supplied from the high pass filter 213, and supplies the high band noise signal obtained as a result to the addition unit 28.

Through the filtering by the poly-phase configuration level adjustment filter 215, the forming of the waveform of the white noise signal, that is, the level adjustment, is performed, and the up-sampling is performed so that the sampling frequency is four times that of the input signal.

In other words, in the poly-phase configuration level adjustment filter 215, the high band noise signal of 192 kHz is generated from the white noise signal of 24 kHz through the filter process using the poly-phase configuration filter configured with the filter coefficients supplied from the high pass filter 213. The poly-phase configuration level adjustment filter 215 has a similar configuration to the poly-phase configuration level adjustment filter 124 illustrated in FIG. 9.

Through the above process, the high band noise signal in which the level adjustment is performed for the respective high band sub bands is generated, and the addition unit 28 obtains the output signal by adding the high band noise signal to the high band signal and the low band signal.

<Description of Frequency Band Expansion Process>

Figure 12:
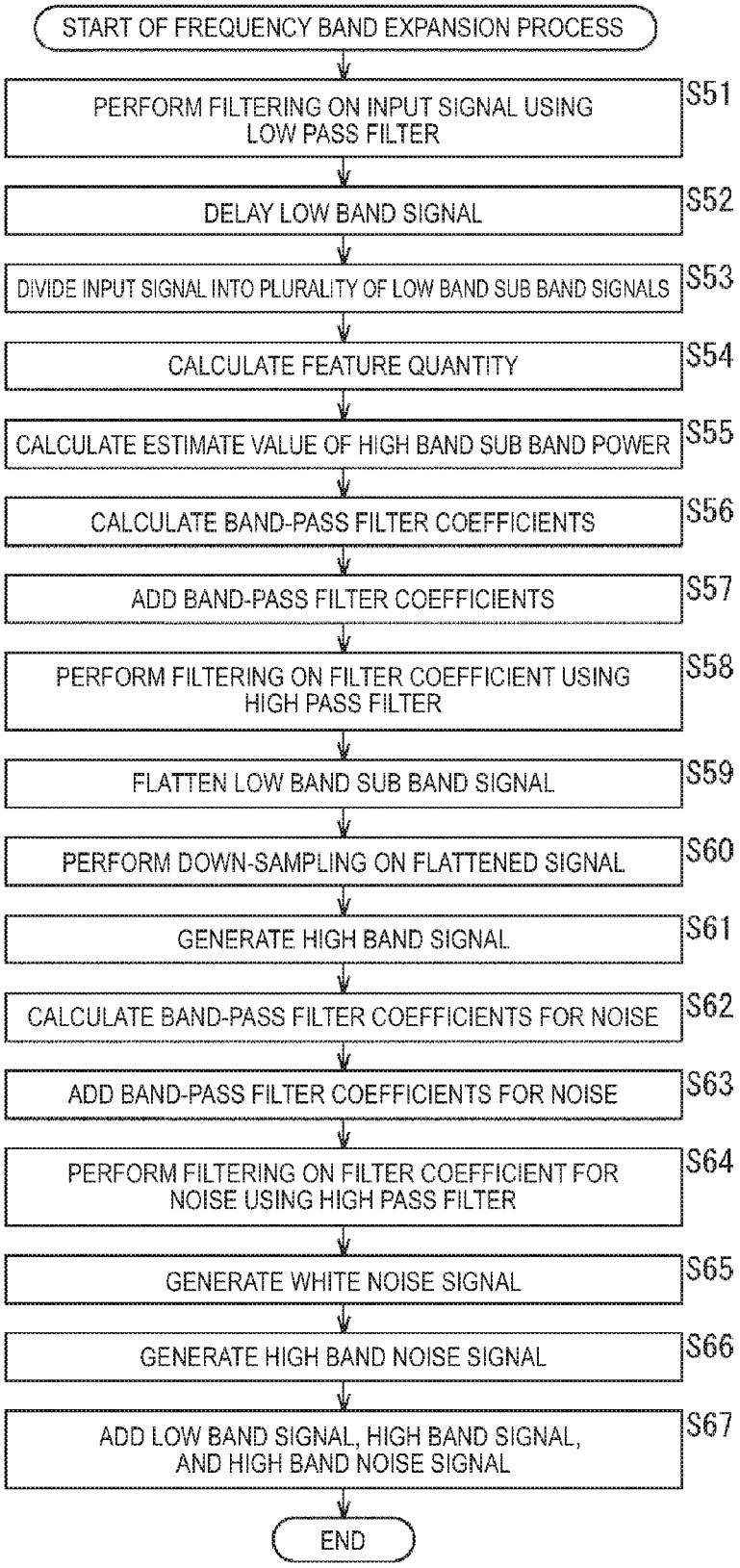
FIG. 12 is a flowchart for describing a frequency band expansion process.

Next, the frequency band expansion process performed by the frequency band expanding device 201 will be described with reference to the flowchart of FIG. 12.

Figure 10:
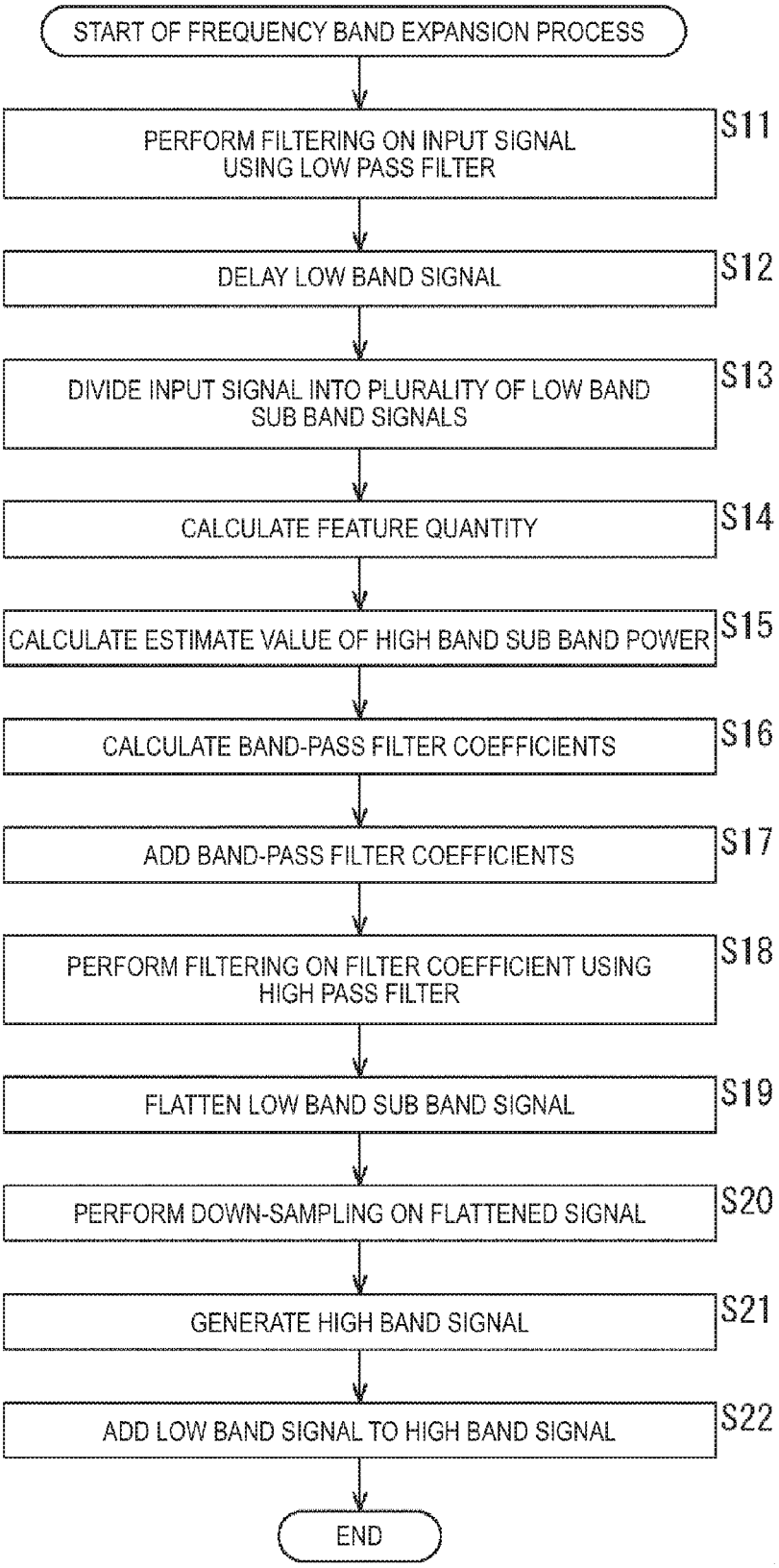
FIG. 10 is a flowchart for describing a frequency band expansion process.

The process of steps S51 to S61 is similar to the process of steps S11 to S21 of FIG. 10, and thus a description thereof is omitted. In step S55, the high band sub band power estimation circuit 25 supplies the obtained quasi-high band sub band power to the band-pass filter calculation circuit 72 and the band-pass filter calculation circuit 211.

In step S62, the band-pass filter calculation circuit 211 calculates the band-pass filter coefficient h_noise(ib,I) for the noise based on the quasi-high band sub band power supplied from the high band sub band power estimation circuit 25, and supplies the calculated band-pass filter coefficient h_noise(ib,I) to the addition unit 212. In other words, the band-pass filter coefficients h_noise(ib,I) are calculated for the respective high band sub bands by calculating Formulas (6) to (8).

As a result, it is possible to add the high band noise signal of the appropriate power according to the quasi-high band sub band power to the high band signal.

In step S63, the addition unit 212 obtains one filter coefficient by adding the band-pass filter coefficients for the noise supplied from the band-pass filter calculation circuit 211, and supplies the obtained filter coefficient to the high pass filter 213. Specifically, the band-pass filter coefficients h_noise(ib,I) of the same sample I of the respective high band sub bands ib are added, and thus the filter coefficient of the sample I is obtained.

In step S64, the high pass filter 213 removes the low band component from the filter coefficient by performing filtering on the filter coefficient for the noise supplied from the addition unit 212 using the high pass filter, and supplies the filter coefficient obtained as a result to the poly-phase configuration level adjustment filter 215.

One filter configured with the filter coefficients of the samples I obtained as described above is a poly-phase configuration filter used in the filter process performed by the poly-phase configuration level adjustment filter 215.

In step S65, the noise generation circuit 214 generates the white noise signal, and supplies the white noise signal to the poly-phase configuration level adjustment filter 215.

In step S66, the poly-phase configuration level adjustment filter 215 generates the high band noise signal by filtering the white noise signal supplied from the noise generation circuit 214 using the filter coefficient supplied from the high pass filter 213.

In the filtering by the poly-phase configuration level adjustment filter 215, the high band noise signal is obtained by performing the level adjustment on the white noise signal, and the up-sampling of the signal is performed at the same time. The poly-phase configuration level adjustment filter 215 supplies the generated high band noise signal to the addition unit 28.

In step S67, the addition unit 28 obtains the output signal by adding the low band signal supplied from the delay circuit 22, the high band signal supplied from the poly-phase configuration level adjustment filter 124, and the high band noise signal supplied from the poly-phase configuration level adjustment filter 215, and outputs the output signal to the subsequent stage. When the output signal is output, the frequency band expansion process ends.

As described above, the frequency band expanding device 201 performs the filtering on the input signal or the flattened signal and the white noise signal through the poly-phase configuration filter, and performs the up-sampling of the signal at the same time as the generation of the low band signal or the high band signal and the high band noise signal. The frequency band expanding device 201 obtains one filter coefficient by adding the band-pass filter coefficients of the high band sub bands in advance, and performs the filtering on the flattened signal or the white noise signal.

Thus, high resolution sound can be obtained with a small processing amount. In other words, high-quality sound can be obtained with a small processing amount.

Further, in the frequency band expanding device 201, as the high band noise signal is generated and added to the high band signal and the low band signal, the appropriate noise component is added to the high band of the output signal, and thus the frequency shape of the high band can have the flat shape. Accordingly, it is possible to obtain the output signal of the more natural frequency shape. In other words, more natural high-quality sound can be obtained.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose computer or the like that is capable of executing various functions when various programs are installed.

Figure 13:
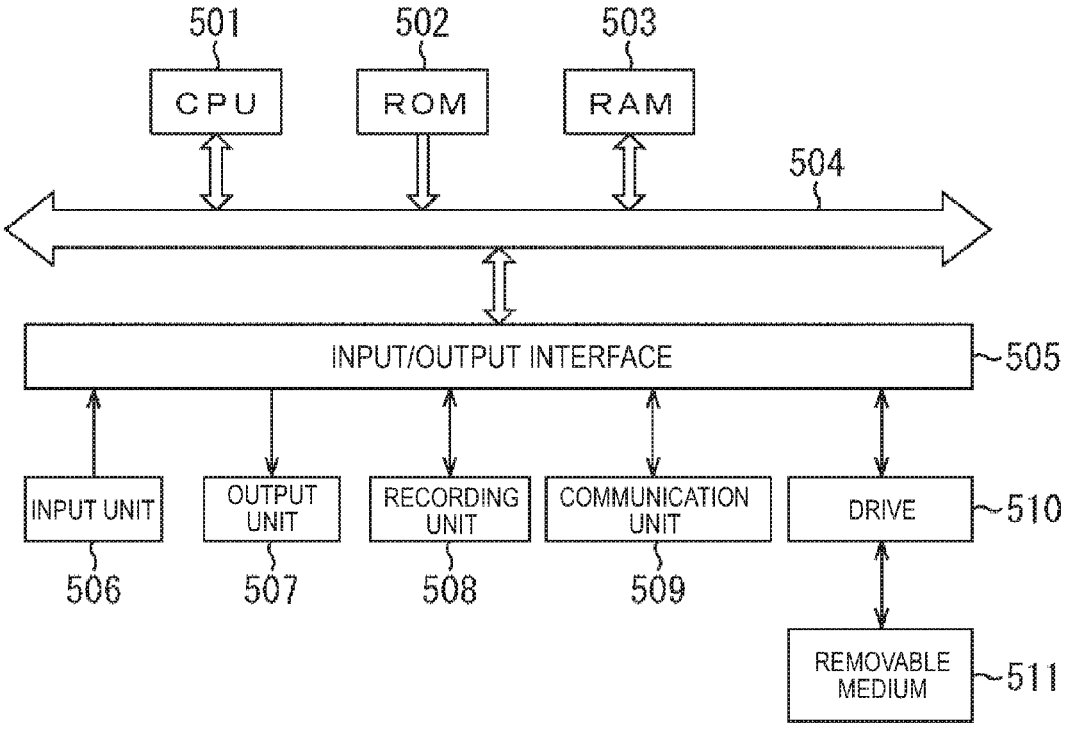
FIG. 13 is a diagram illustrating an exemplary configuration of a computer.

FIG. 13 is a block diagram showing a hardware configuration example of a computer that performs the above-described series of processing using a program.

In the computer, a central processing unit (CPU) 501, a read only memory (ROM) 502 and a random access memory (RAM) 503 are mutually connected by a bus 504.

An input/output interface 505 is also connected to the bus 504. An input unit 506, an output unit 507, a recording unit 508, a communication unit 509, and a drive 510 are connected to the input/output interface 505.

The input unit 506 is configured from a keyboard, a mouse, a microphone, an imaging device or the like. The output unit 507 is configured from a display, a speaker or the like. The recording unit 508 is configured from a hard disk, a non-volatile memory or the like. The communication unit 509 is configured from a network interface or the like. The drive 510 drives a removable medium 511 such as a magnetic disk, an optical disk, a magneto-optical disk, a semiconductor memory or the like.

In the computer configured as described above, as one example the CPU 501 loads a program recorded in the recording unit 508 via the input/output interface 505 and the bus 504 into the RAM 503 and executes the program to carry out the series of processes described earlier.

As one example, the program executed by the computer (the CPU 501) may be provided by being recorded on the removable medium 511 as a packaged medium or the like. The program can also be provided via a wired or wireless transfer medium, such as a local area network, the Internet, or a digital satellite broadcast.

In the computer, by loading the removable medium 511 into the drive 510, the program can be installed into the recording unit 508 via the input/output interface 505. It is also possible to receive the program from a wired or wireless transfer medium using the communication unit 509 and install the program into the recording unit 508. As another alternative, the program can be installed in advance into the ROM 502 or the recording unit 508.

It should be noted that the program executed by a computer may be a program that is processed in time series according to the sequence described in this specification or a program that is processed in parallel or at necessary timing such as upon calling.

An embodiment of the disclosure is not limited to the embodiments described above, and various changes and modifications may be made without departing from the scope of the disclosure.

For example, the present disclosure can adopt a configuration of cloud computing which processes by allocating and connecting one function by a plurality of apparatuses through a network.

Further, each step described by the above mentioned flow charts can be executed by one apparatus or by allocating a plurality of apparatuses.

In addition, in the case where a plurality of processes is included in one step, the plurality of processes included in this one step can be executed by one apparatus or by allocating a plurality of apparatuses.

Effects described in the present description are just examples, the effects are not limited, and there may be other effects.

Additionally, the present technology may also be configured as below.

(1) A frequency band expanding device, including:

a low band extraction band-pass filter processing unit configured to pass a predetermined band of a low band side of an input signal and extract a low band sub band signal;

a filter coefficient calculation unit configured to calculate a filter coefficient of a poly-phase configuration filter based on the low band sub band signal or the input signal;

a level adjustment filter processing unit configured to perform up-sampling and level adjustment of the low band sub band signal by filtering the low band sub band signal through the poly-phase configuration filter of the filter coefficient and generate a high band signal;

a low pass filter processing unit configured to extract a low band signal from the input signal through filtering on the input signal; and a signal addition unit configured to add the low band signal to the high band signal and generate an output signal.

(2) The frequency band expanding device according to (1), further including:

a flattening unit configured to flatten the low band sub band signal in a manner that levels of the low band sub band signals of a plurality of different bands are substantially constant and generate a flattened signal; and a down-sampling unit configured to perform down-sampling on the flattened signal, wherein the level adjustment filter processing unit performs filtering on the flattened signal down-sampled by the down-sampling unit using the poly-phase configuration filter, and generates the high band signal.

(3) The frequency band expanding device according to (2), wherein the flattening unit performs the flattening in a manner that levels of the low band sub band signals of a plurality of bands are substantially the same as a level of the low band sub band signal of a band at a highest band side.

(4) The frequency band expanding device according to any one of (1) to (3), wherein the filter coefficient calculation unit calculates band-pass filter coefficients of band-pass filters that passes a plurality of bands of a high band, and the frequency band expanding device further includes a coefficient addition unit configured to obtain one filter coefficient by adding the band-pass filter coefficients calculated for the plurality of bands of the high band.

(5) The frequency band expanding device according to (4), further including:

an estimating unit configured to calculate estimate values of levels of signals of the bands for the plurality of bands of the high band based on the low band sub band signals of the plurality of different bands, wherein the filter coefficient calculation unit calculates the band-pass filter coefficients based on the estimate values of the bands for the plurality of bands of the high band.

(6) The frequency band expanding device according to any one of (1) to (5), further including:

a noise generating unit configured to generate a high band noise signal, wherein the signal addition unit adds the low band signal, the high band signal, and the high band noise signal and generates the output signal.

(7) The frequency band expanding device according to (6), further including:

a noise level adjustment filter processing unit configured to perform up-sampling and level adjustment on the high band noise signal by performing filtering on the high band noise signal through a poly-phase configuration filter for noise.

(8) The frequency band expanding device according to (7), further including:

a noise filter coefficient calculation unit configured to calculate a filter coefficient of the poly-phase configuration filter for the noise based on the low band sub band signal or the input signal.

(9) The frequency band expanding device according to any one of (1) to (8), wherein the low pass filter processing unit performs up-sampling of the input signal and extraction of a low band component by performing filtering on the input signal through a poly-phase configuration filter for a low band, and generates the low band signal.

(10) A frequency band expansion method, including steps of:

passing a predetermined band of a low band side of an input signal and extracting a low band sub band signal;

calculating a filter coefficient of a poly-phase configuration filter based on the low band sub band signal or the input signal;

performing up-sampling and level adjustment of the low band sub band signal by filtering the low band sub band signal through the poly-phase configuration filter of the filter coefficient and generating a high band signal;

extracting a low band signal from the input signal through filtering on the input signal; and adding the low band signal to the high band signal and generating an output signal.

(11) A program causing a computer to execute a process including steps of:

passing a predetermined band of a low band side of an input signal and extracting a low band sub band signal;

calculating a filter coefficient of a poly-phase configuration filter based on the low band sub band signal or the input signal;

performing up-sampling and level adjustment of the low band sub band signal by filtering the low band sub band signal through the poly-phase configuration filter of the filter coefficient and generating a high band signal;

extracting a low band signal from the input signal through filtering on the input signal; and adding the low band signal to the high band signal and generating an output signal.

REFERENCE SIGNS LIST

23 low band extraction band-pass filter
24 feature quantity calculation circuit
25 high band sub band power estimation circuit
28 addition unit
72 band-pass filter calculation circuit
73 flattening circuit
74 down-sampling unit
111 frequency band expanding device
121 poly-phase configuration low pass filter
122 addition unit
123 high pass filter
124 poly-phase configuration level adjustment filter
211 band-pass filter calculation circuit
214 noise generation circuit
215 poly-phase configuration level adjustment filter

The invention claimed is:

1. A frequency band expanding device, comprising:

a low band extraction band-pass filter processing unit configured to pass a particular band of a low band side of an input signal and extract a low band sub band signal;

a filter coefficient calculation unit configured to calculate a first filter coefficient of a first poly-phase configuration filter based on one of the low band sub band signal or the input signal;

a level adjustment filter processing unit configured to up-sample the low band sub band signal based on filtration of the low band sub band signal via the first poly-phase configuration filter of the first filter coefficient and generate a high band signal;

a low pass filter processing unit configured to extract a low band signal from the input signal via filtration of the input signal; and a signal addition unit configured to generate an output signal based on addition of the low band signal to the high band signal.

2. The frequency band expanding device according to claim 1, further comprising:

a flattening unit configured to flatten the low band sub band signal in a manner that level of the low band sub band signal is constant and generate a flattened signal; and a down-sampling unit configured to down-sample the flattened signal, wherein the level adjustment filter processing unit is further configured to filter the down-sampled flattened signal via the first poly-phase configuration filter, and generate the high band signal.

3. The frequency band expanding device according to claim 2, wherein the flattening unit is further configured to flatten the low band sub band signal in a manner that the level of the low band sub band signal is same as a level of the low band sub band signal at a highest band side.

4. The frequency band expanding device according to claim 1, wherein the filter coefficient calculation unit is further configured to calculate band-pass filter coefficients, of band-pass filters that passes a plurality of bands of a high band, and the frequency band expanding device further comprises a coefficient addition unit configured to obtain a second filter coefficient based on addition of the band-pass filter coefficients.

5. The frequency band expanding device according to claim 4, further comprising:

an estimating unit configured to calculate estimate value, of level of signal of one of the bands for the plurality of bands of the high band, based on the low band sub band signal, wherein the filter coefficient calculation unit is further configured to calculate one of the band-pass filter coefficients based on the estimate value.

6. The frequency band expanding device according to claim 1, further comprising:

a noise generating unit configured to generate a high band noise signal, wherein the signal addition unit is further configured to add the low band signal, the high band signal, and the high band noise signal and generate the output signal.

7. The frequency band expanding device according to claim 6, further comprising:

a noise level adjustment filter processing unit configured to up-sample the high band noise signal based on filtration of the high band noise signal via a second poly-phase configuration filter for noise.

8. The frequency band expanding device according to claim 7, further comprising:

a noise filter coefficient calculation unit configured to calculate a second filter coefficient of the second poly-phase configuration filter for the noise based on one of the low band sub band signal or the input signal.

9. The frequency band expanding device according to claim 1, wherein the low pass filter processing unit is further configured to up-sample the input signal and extract a low band component based on filtration of the input signal via a second poly-phase configuration filter for a low band, and generate the low band signal.

10. A frequency band expansion method, comprising:

passing a particular band of a low band side of an input signal and extracting a low band sub band signal;

calculating a filter coefficient of a poly-phase configuration filter based on one of the low band sub band signal or the input signal;

up-sampling the low band sub band signal by filtering the low band sub band signal via the poly-phase configuration filter of the filter coefficient and generating a high band signal;

extracting a low band signal from the input signal via filtering the input signal; and generating an output signal based on addition of the low band signal and the high band signal.

11. A non-transitory computer-readable medium having stored thereon computer-readable instructions, which when executed by a computer, cause the computer to execute operations, the operations comprising:

passing a particular band of a low band side of an input signal and extracting a low band sub band signal;

calculating a filter coefficient of a poly-phase configuration filter based on the low band sub band signal or the input signal;

up-sampling the low band sub band signal by filtering the low band sub band signal via the poly-phase configuration filter of the filter coefficient and generating a high band signal;

extracting a low band signal from the input signal via filtering the input signal; and generating an output signal based on addition of the low band signal and the high band signal.

* * * * *